US005220898A

United States Patent [19]

Kidokoro et al.

[11] Patent Number: 5,220,898

[45] Date of Patent: Jun. 22, 1993

[54] PRESSURE CONTROL SYSTEM FOR CONTROLLING PRESSURE IN FUEL TANK OF ENGINE BY CONTROLLING DISCHARGING OF EVAPORATED FUEL IN FUEL TANK INTO CANISTER

[75] Inventors: Toru Kidokoro, Susono; Takaaki Itoh, Mishima; Yoshihiko Hyodo; Akinori Osanai, both of Susono, all of Japan

[73] Assignee: Toyota Jidosha Kabushiki Kaisha, Toyota, Japan

[21] Appl. No.: 927,895

[22] Filed: Aug. 10, 1992

[30] Foreign Application Priority Data

| | | | |
|---|---|---|---|
| Aug. 22, 1991 | [JP] | Japan | 3-210725 |
| Jan. 10, 1992 | [JP] | Japan | 4-003225 |
| Feb. 10, 1992 | [JP] | Japan | 4-023951 |

[51] Int. Cl.[5] ..... F02M 33/02

[52] U.S. Cl. ..... 123/520; 123/519

[58] Field of Search ..... 123/518, 519, 520, 516, 123/521

[56] References Cited

U.S. PATENT DOCUMENTS

| | | | |
|---|---|---|---|
| 3,854,911 | 12/1974 | Walker | 123/519 |
| 4,116,184 | 9/1978 | Tomita | 123/519 |
| 4,343,281 | 8/1982 | Uozumi | 123/519 |
| 4,903,672 | 2/1990 | Mackinnon | 123/520 |
| 5,036,823 | 8/1991 | Mackinnon | 123/520 |
| 5,056,493 | 10/1991 | Holzer | 123/520 |
| 5,123,459 | 6/1992 | Toshihiro | 123/520 |

FOREIGN PATENT DOCUMENTS

| | | |
|---|---|---|
| 2542446 | 4/1977 | Fed. Rep. of Germany . |
| 105906 | 4/1976 | Japan . |
| 78746 | 7/1980 | Japan . |
| 28736 | 9/1980 | Japan . |
| 1-30254 | 1/1990 | Japan . |

*Primary Examiner*—Carl S. Miller

*Attorney, Agent, or Firm*—Kenyon & Kenyon

[57] ABSTRACT

A pressure control device allows evaporated fuel evaporated in an fuel tank of an engine to be discharged to a canister during the engine running state. The canister absorbs the evaporated fuel. The pressure control device continues to allow evaporated fuel in the fuel tank to be discharged to the canister after the engine stops until a predetermined period has elapsed. The pressure control device allows evaporated fuel in the fuel tank to be discharged to the canister while a pressure in the fuel tank is higher than a first predetermined pressure after the predetermined period has elapsed in the engine stopped state. On the other hand, the pressure control device prevents evaporated fuel in the fuel tank from being discharged to the canister while a pressure in the fuel tank is lower than the first predetermined pressure after the predetermined period has elapsed in the engine stopped state.

20 Claims, 16 Drawing Sheets

PRESSURE CONTROL SYSTEM FOR CONTROLLING PRESSURE IN FUEL TANK OF ENGINE BY CONTROLLING DISCHARGING OF EVAPORATED FUEL IN FUEL TANK INTO CANISTER

BACKGROUND OF THE INVENTION (1) Field of the invention

The present invention qenerally relates to a pressure control system of a below mentioned "evapo-purge system" for controlling a pressure in a fuel tank of an internal combustion engine wherein evaporated fuel in the fuel tank is treated so that it is discharged into an air intake system.

(2) Description of the Related Art

Evaporated fuel in a fuel tank of an internal combustion engine is treated in a conventional "evapo-purge system" so that the evaporated fuel, generated in the fuel tank and other portions in the engine containing the fuel therein, is to be absorbed in active carbon, the evaporated fuel absorbed in the active carbon then being purged from the active carbon into an air intake system.

The Japanese Laid-open Utility Model Application No. 51-105906 discloses such a conventional "evapo-purge system". A check valve is provided in a path in the conventional evaporated system, which path connects between a fuel tank and a canister. The check valve allows evaporated fuel in the fuel tank to be discharged into the canister if a pressure in the fuel tank is higher than a first predetermined pressure thereof. After stopping the engine, the pressure in the fuel tank is controlled to be not higher than the first predetermined pressure by the check valve.

Generally speaking, a temperature of fuel in a fuel tank of an engine, particularly a temperature of fuel located in a central portion of the fuel tank, increases during several seconds soon after the engine stopping, because heat is given to the fuel tank from a sub-tank. Thus, fuel in the fuel tank continues to evaporate.

The check valve of the above conventional "evapo-purge system" closes soon after the engine stopping, which valve has been opened until the engine stops. The check valve is controlled after the engine is stopped so that a pressure in the fuel tank may be not higher than the first predetermined pressure. Thus, the pressure in the fuel tank increases sharply up to the first predetermined pressure because heat is given to the fuel tank from the sub-tank soon after the engine is stopped as mentioned above.

If somebody opens a fuel-supply-cap of the fuel tank for supply of fuel therein in such condition thereof, evaporated fuel may be leaked into atmosphere because pressure in the fuel tank is higher than the atmospheric pressure (the first predetermined pressure is higher than the atmospheric pressure). This leak of fuel is a fuel economy and/or environmental problem.

To overcome the problem, the Japanese Laid-open Patent Application No. 2-130254 discloses an improved pressure control system of an "evapo-purge system". The pressure control system is used for reducing evaporation of fuel in a fuel tank of an internal combustion engine and reducing an amount of evaporated fuel evaporated in the fuel tank discharged into a canister. A pressure-controlled-pressure-relief-valve and a constraint-pressure-relief-valve are provided in parallel to each other in a path in the pressure control system, the path connecting a fuel tank of an engine with a canister. The pressure-controlled-pressure-relief-valve controls a pressure in the fuel tank to be not higher than a first predetermined pressure, which first predetermined pressure is higher than the atmospheric pressure. The constraint-pressure-relief-valve is controlled by an external command therefor. Both valves are controlled so as to fllow evaporated fuel in the fuel tank to be discharged into the canister or prevent it from being discharged thereinto.

FIG. 1 shows a concept of the pressure control system. The constraint-pressure-relief-valve closes in the engine running state as shown in a step (the term "step" will be omitted for the sake of simplification hereinafter) S1 of FIG. 1 in order to reduce evaporation of fuel in the fuel tank. Thus, the pressure-controlled-pressure-relief-valve controls pressure in the fuel tank as shown in S2 so that the pressure therein may be controlled to be not higher than the first predetermined pressure P1 as shown in S3. The constraint-pressure-relief-valve opens as shown in S5 after stopping the engine until a predetermined period $\Delta$ t elapsed as shown in S4 in order to prevent discharging of evaporated fuel through a fuel-supply-cap of the fuel tank at a time of the cap being opened for supply of fuel. As a result of the opening of the valve, evaporated fuel in the fuel tank is discharged into the canister, a pressure in the fuel tank thus decreasing as shown in S6.

The constraint-pressure-relief-valve closes again since the above predetermined period $\Delta t$ elapsed as shown in S7 in the engine stopped state. Thus, the pressure-controlled-pressure-relief-valve controls pressure in the fuel tank as shown in S8 so that the pressure may be controlled to be not higher than the first predetermined pressure P1 as shown in S9. Thus, pressure in the fuel tank increases up to the first predetermined pressure P1, which pressure is higher than the atmospheric pressure as mentioned above. Thus, evaporation of fuel in the fuel tank is restrained and discharging of evaporated fuel into the canister from the fuel tank is restrained in the engine stopped state.

The problem of the above mentioned pressure control system is described below. Before stopping the engine, pressure in the fuel tank is controlled to be not higher than the first predetermined pressure P1, which is higher than the atmospheric pressure as mentioned above. Thus, when the constraint-pressure-relief-valve opens since the engine running as mentioned above, pressure in the fuel tank reduces quickly to the atmospheric pressure. Then large amount of evaporation of fuel in the fuel tank may occur as a result of sharp variation of pressure therein.

In particular, a temperature of fuel in the fuel tank is high soon after stopping the engine as mentioned above. As a result of this high temperature of fuel in the fuel tank, an ebullition-under-reduced-pressure-state may occur in the fuel tank. Then if the ebullition-under-reduced-pressure-state occurs, significant evaporation occur and a considerable period may be needed before pressure in the fuel tank reduces to reach a desired pressure so that the evaporation stops.

As a result of the considerable period needed until the evaporation stops, the amount of evaporated fuel discharged into the canister may exceed an absorption capacity of the canister, that is, a saturation state of the canister. This saturation state of the canister may cause evaporated fuel discharged into the canister to be discharged into atmosphere through the canister. The considerable period needed until the evaporation stopping also may interfere with the normal functioning of a fuel-supply-excess-preventing-mechanism so that excess supply of fuel into the fuel tank may occur.

SUMMARY oF THE INVENTION

An object of the present invention is to provide a pressure control system for controlling pressure in a fuel tank properly so as to prevent discharging of evaporated fuel into atmosphere.

To achieve the object of the present invention, the pressure control system according to the present invention comprises:

a pressure control means for allowing evaporated fuel in an fuel tank of an engine to be discharged to a canister during the engine running state, the canister absorbing the evaporated fuel; the pressure control means allowing evaporated fuel in the fuel tank to be discharged to the canister since the engine stopping until a predetermined period$\Delta$ t has elapsed; the pressure control means allowing evaporated fuel in the fuel tank to be discharged to the canister while a pressure in the fuel tank is higher than a first predetermined pressure P1 since the predetermined period $\Delta$ t elapsed in the engine stopped state; or the pressure control means preventing evaporated fuel in the fuel tank from being discharged to the canister while a pressure in the fuel tank is lower than the first predetermined pressure P1 since the predetermined period $\Delta$ t has elapsed in the engine stopped state.

It is not necessary to open a valve so as to allow evaporated fuel in the fuel tank to be discharged into the canister at the time of the engine stopping with the pressure control means according to the present invention as mentioned above. This because evaporated fuel in the fuel tank has been already allowed to be discharged by the pressure control means in the engine running state, that is, before stopping the engine as mentioned above. Thus, the above mentioned saturation state of the canister does not occur, because sharp pressure variation in the fuel tank due to a valve opening does not occur. Thus, discharging of evaporated fuel into the atmosphere through the canister is prevented and excess supply of fuel into the fuel tank due to an abnormal function of the above mentioned fuel-supply-excess-preventing-mechanism is also prevented. This abnormal function may occur due to the considerable period needed before the cessation of evaporating of fuel as mentioned above.

Other objects, features and advantages of the present invention will become more apparent from the following detailed description when read in conjunction with the accompanying drawings.

DESCRIPTION oF THE PREFERRED EMBODIMENT

Figure 3:
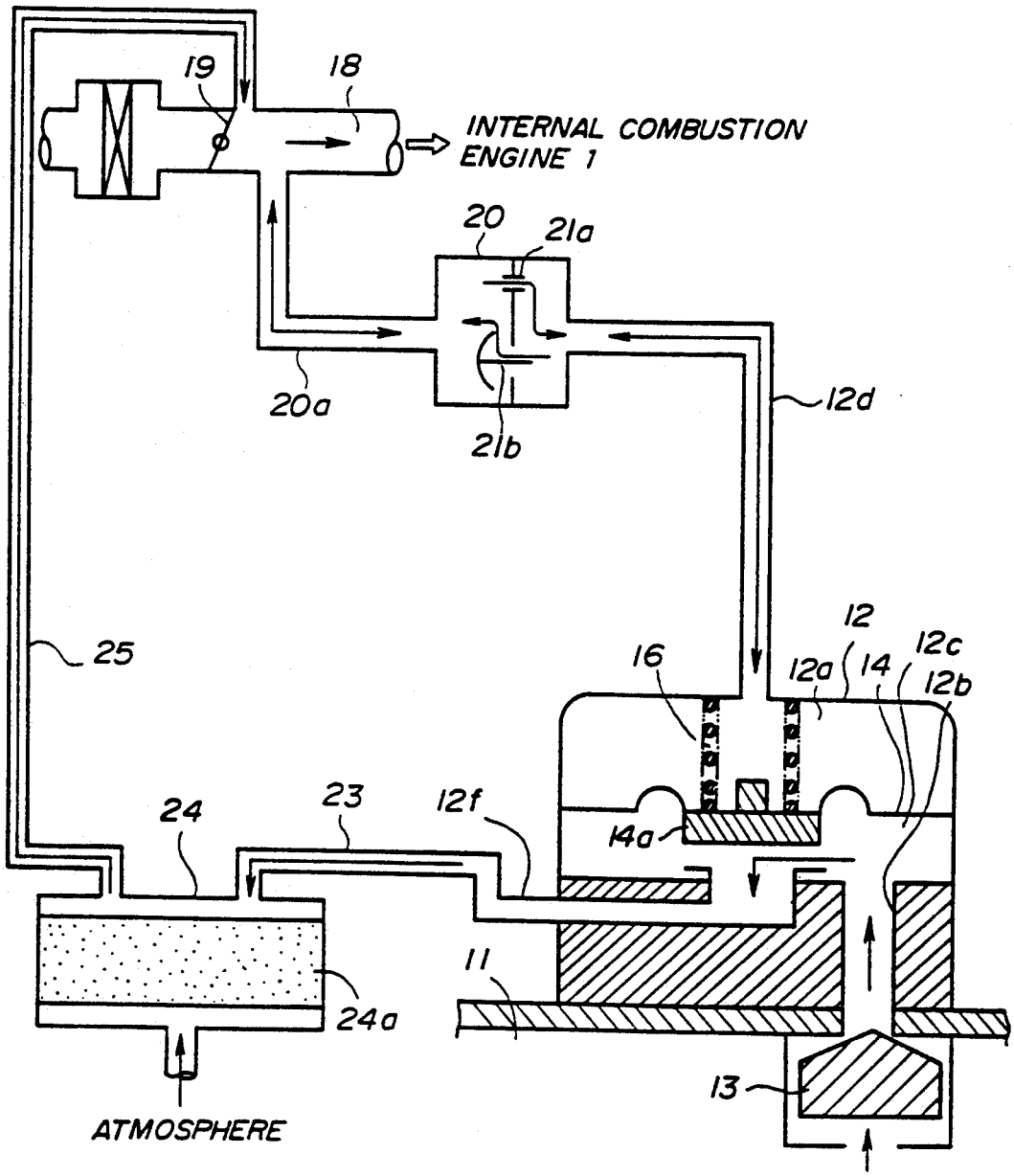
FIG. 3 shows a component diagram of the first embodiment.

A composition of a first embodiment of a pressure control system according to the present invention will be described below in conjunction with FIG. 3. A pressure control valve device 12 is mounted on a top position of a fuel tank 11 of an engine. A cut-off-valve 13 serving as the above mentioned fuel-supply-excess-preventing-mechanism is fitted on a bottom of an inlet path **12*b* of the fuel tank 11, the inlet path 12*b* connecting the fuel tank 11 and the pressure control valve device 12**.

A construction of the valve device 12 is given below The valve device 12 has an upper located control cavity **12*a* and a lower located connecting cavity 12*c*. Both cavities are separated by diaphragm 14. A valve device 14*a* is provided in a central position of the diaphragm 14. Further, a compression spring 16 are provided in the control cavity 12*a*, a resilient of which spring 16 gives a function to the valve body 14*a* so as to press it downward. The inlet path 12*b* connects the connecting cavity with the cut-off valve 13. The valve body 14*a* can shut a pass, which connects the connecting cavity 12*c* with a port 12*f*** by moving downward.

The valve body **14*a* is lifted counteracting the compression spring 16 if a pressure in the control cavity 12*a* becomes negative pressure. As a result of this lifting of the valve body 14*a*, the connecting cavity 12*c* is connected with a canister 24 through a port 12*f* and a path 23, this action being referred by "opening of the valve device 12" hereinafter. on the other hand, an action of the valve body 14*a* such as shutting a path to the canister 24 will be referred by "closing of the device 12". The resilience of the compression spring 16 is determined so that the the valve device 12 opens while a pressure in the fuel tank 11 is higher than a first predetermined pressure P1**, the first predetermined pressure P1 being higher than the atmospheric pressure, otherwise the valve device 12 closes.

Figure 1:
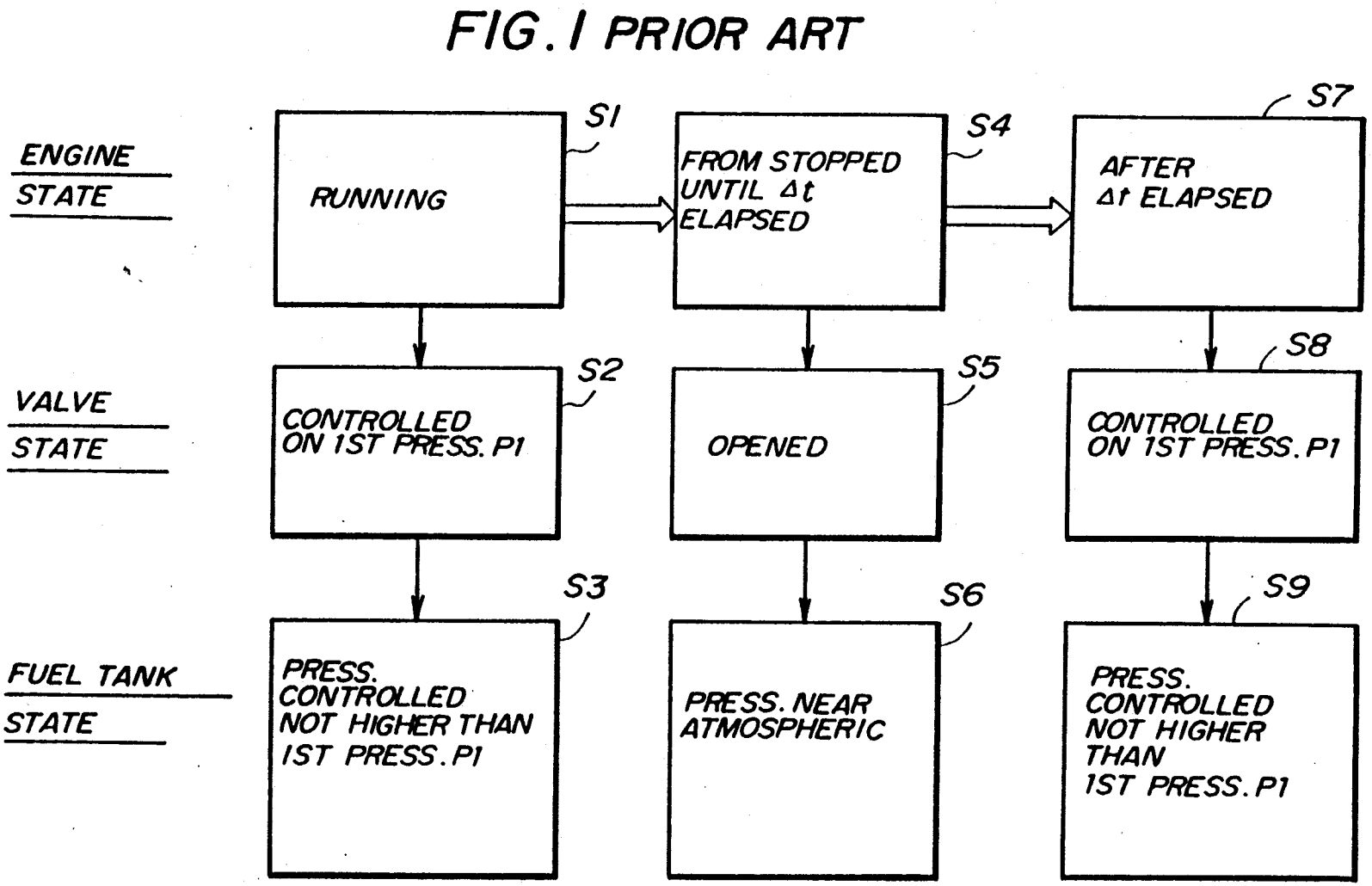
FIG. 1 PRIOR ART
FIG. 1 shows a concept illustration for an operation of the conventional pressure control system.
Figure 2:
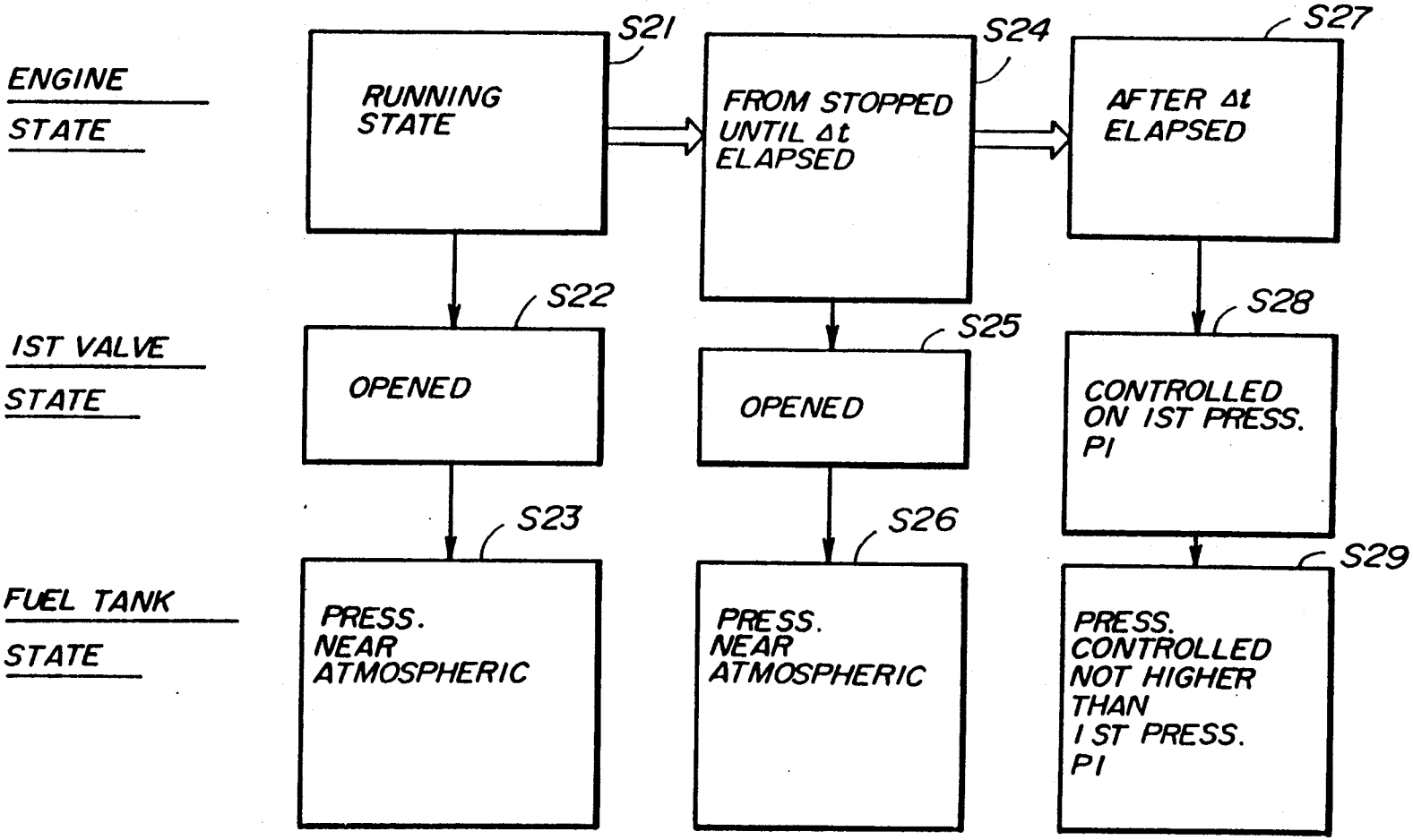
FIG. 2 shows a concept illustration for an operation of first and second embodiments of a pressure control system according to the present invention.

Air flows into the internal combustion engine 1 through a intake path 18 (an intake system) in the engine 1 running state as shown in S21 of FIG. 2, thus air escapes from a vacuum-pressure-time-delay-valve (it will be referred by "VTV" hereinafter) 20 into the intake path 18 through a path 20*a*, which is connected to the intake path 18 in a down stream side of a throttle valve 19. This is because of the Bernoulli's effect. As a result of air escaping from the VTV 20, air escapes from the control cavity 12*a* of the valve device 12 through a path 12*d*. This is because of air passing through a check valve 21*b* from the path 12*d* to the path 20*a* as shown by an arrow, the check valve 21*b* allowing it. This results in the pressure in the control cavity 12*a* becoming a negative pressure, the valve device 12 thus opening as mentioned above as shown in S22. This means that evaporated fuel in the fuel tank 11 is allowed to be discharged into a canister 24 through the valve device 12 in the engine 1 running state. In addition, this means the pressure in the tank 11 becomes near atmospheric pressure as shown in S23.

Air stops flowing into the engine 1 through the intake path 18 at a time of stopping the engine 1 as shown in S24, thus the Bernoulli's effect has no effect after that time. Air begins to flow from the control cavity 12*a* up to the intake path 18 through the path 12*d*, an orifice 21*a* in the VTV 20, and the path 20*a*. This is because of the negative pressure in the control cavity 12*a*. The speed of this air flow is slow because of it passing through the orifice 21*a*, which has a small diameter. Thus, the pressure in the cavity 12*a* increases gradually up to the atmospheric pressure. Then when the pressure in the cavity 12*a* becomes the atmospheric pressure, a period elapsed since stopping the engine until the present time being referred by Δ t, as shown in S27, an operation of the valve device 12 such as opening or closing is controlled depending on the pressure in the fuel tank 11 so that the valve device 12 opens when the pressure in the tank 11 is higher than the first predetermined pressure P1, otherwise it closes as mentioned above as shown in S28. This results in the pressure in the tank 11 being controlled to be not higher than the first predetermined pressure P1 as shown in S29.

Evaporated fuel (it will be referred by " vapor" hereinafter) discharged from a port 12*f* is supplied to the canister 24 through the path 23, the vapor thus being absorbed by an active carbon 24*a* provided in the canister 24. The canister 24 is connected into the intake path 18 through the path 25, the path 25 being connected in a position downstream side of and close to the throttle valve 19. During the engine 1 running state, air escapes into the intake path 18 because of the above mentioned Bernoulli's effect, vapor absorbed in the active carbon 24*a* thus escaping into the engine 1 through the intake path 18 with air flow in the intake path 18.

Figure 4A:
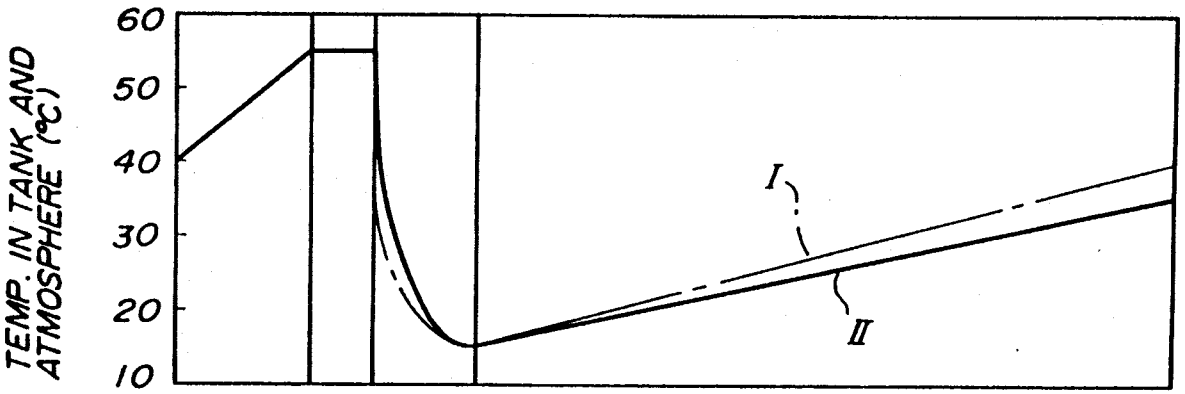
FIGS. 4A and 4B respectively show examples of timing charts of temperatures of fuel in a fuel tank and the atmosphere and a pressure in the fuel tank of an engine concerning the first and second embodiments.
Figure 4B:
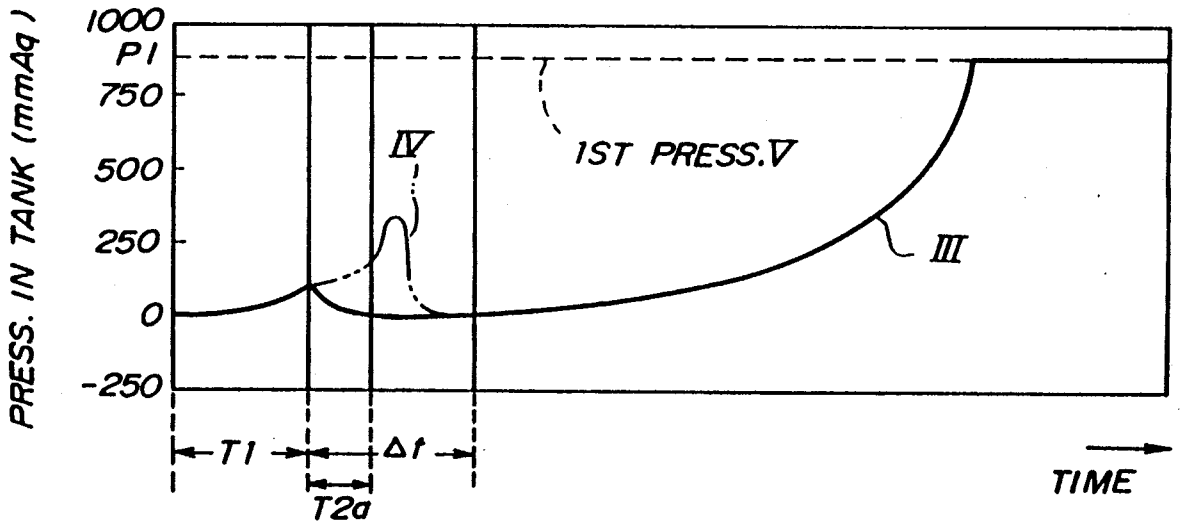

Variations of temperatures of fuel in the fuel tank 11 and atmosphere and the pressure in the tank 11 are described below in conjunction with FIGS. 4A and 4B. A chain line I of FIG. 4A shows a temperature of the atmosphere and a solid line II of FIG. 4A shows a temperature of fuel in the tank 11. A dashed line V of FIG. 4B shows the above mentioned first predetermined pressure P1. A solid line III of FIG. 4B shows a pressure in the tank 11 in the first embodiment of a pressure control system according to the present invention, and a chain double-dashed line IV of FIG. 4B shows a pressure in a fuel tank in a conventional pressure control system wherein a valve for discharging vapor in the fuel tank to a canister is controled so that the pressure in the tank is controlled to be not higher than the above mentioned first predetermined pressure P1 shown in the dashed line V of FIG. 4B, which is higher than the atmospheric pressure.

A period T1 shows a condition where the engine 1 runs and a temperature of atmosphere is high. A temperature of fuel in the tank 11 is high because of the high atmospheric temperature during the period T1, a large amount of vapor is thus evaporated in the tank 11. The valve device 12 opens in the engine 1 running state as shown in S21, S22 of FIG. 2, the pressure in the tank 11 thus being near the atmospheric pressure as shown in S23 of FIG. 2 and the solid line III in T1 of FIG. 4B.

A period Δ t shows a condition where a temperature of fuel in the tank 11 is high soon after stopping the engine 1 as mentioned above. A large amount of vapor is formed in the tank 11 because of this high temperature. Thus the pressure in the tank in the above mentioned conventional pressure control system increases as shown in the chain double-dashed line IV of FIG. 4B up to such a pressure as the first predetermined pressure P1 shown in the dashed line V higher than the atmospheric pressure on the other hand, the valve device 12 opens during Δ t as shown in S24, S25 of FIG. 2 as mentioned above in the first embodiment. Thus increasing of the pressure in the tank 11 is prevented as shown in S26. It should be noted that a period T2a in FIGS. 4A and 4B, which is a first half of the period Δ t, is indicated therein so that the period T2a is expanded in comparison with other periods for the sake of showing the condition clearly.

The temperature of the atmosphere increases gradually after the time of that of the period Δ t has elapsed in the example of FIGS. 4A and 4B as shown in the chain line I of FIG. 4A. Thus, the temperature of the tank 11 increases as shown in the solid line II of FIG. 4A. As a result of this, vapor is formed in the tank 11, which causes increasing pressure in the tank 11 as shown in the solid line III of FIG. 4B. Then when the pressure of the tank 11 reaches the above mentioned first predetermined pressure P1 shown in the dashed line V of FIG. 4B, the valve device 12 opens to discharge vapor in the tank 11, because the valve device 12 controls the pressure in the tank 11 so that the pressure is not higher than P1. The vapor discharged from the tank 11 through the valve device 12 is absorbed by the active carbon 24*a* of the canister 24 as mentioned above.

Figure 5:
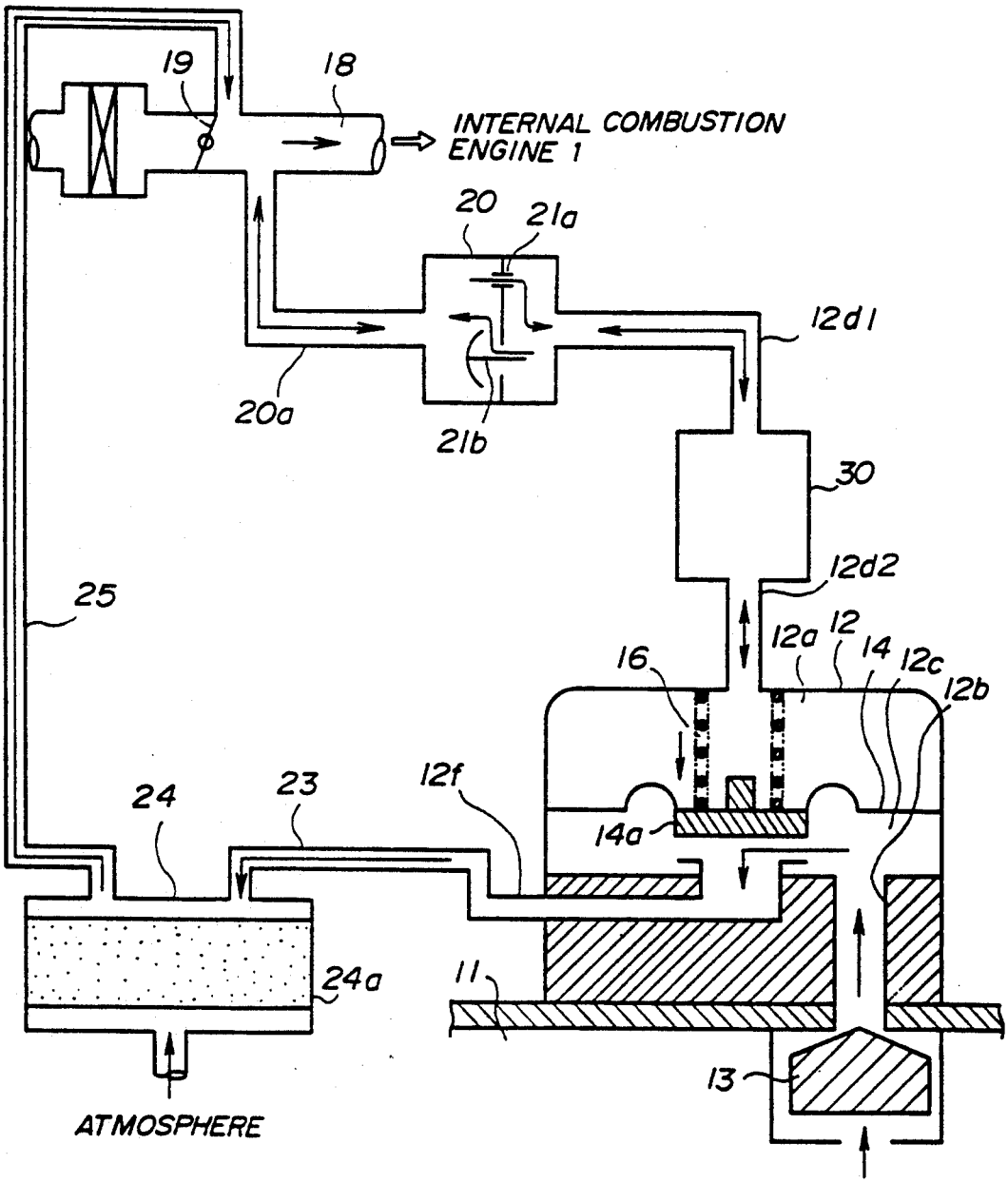
FIG. 5 shows a component diagram of the second embodiment.

A composition of a second embodiment of the pressure control system according to the present invention is described below in conjunction to FIG. 5. A description for parts of the second embodiment, which are same as parts of the first embodiment shown in FIG. 3, is omitted. The same numerals as those given to the parts of the first embodiment are also given to the corresponding parts of the second embodiment.

A point of difference between the both embodiments is that a vacuum tank 30, which serves as a time adjustment means, is provided between the VTV 20 and the valve device 12 in the second embodiment.

In some case where a temperature of the atmosphere is high and a period of the engine 1 running is long, the temperature of the tank 11 may increase up to near 60 degrees centigrade. In this case, evaporation of fuel in the tank 11 is active after stopping the engine 1. Thus the period Δ t determined by the VTV 20 may not be so long that the valve device 12 keeps opening until the active evaporation of fuel in the tank 11 stops. It may be possible to minimize the diameter of the orifice 21*a* of the VTV 20 to obtain a desired length of the period Δ t. However, the Δ t may not stabilize but vary depending on various causes because of the smallness of the diameter of the orifice 21*a*.

As a result of providing of the vacuum tank 30 such as in the second embodiment, the capacity of the tank 30 being several tens of cubic centimeters, it may be possible to determine a length of the period Δ t such as several minutes, during which the valve device 12 keeps an opening state after the engine 1 stopping moment.

The method for opening the device 12 is not limited to one of the above mentioned embodiments. That is, it is possible to replace a method for opening the valve device 12 such as using air in the control cavity 12*a* escapes because of Bernoulli's effect, for example, by the following one. The method is that the valve device 12 opens because of a signal generated when an ignition switch of the engine 1 turns "ON". In this case, a time delay means may be used such as a time delay apparatus which makes a desired time delay Δ t by means of electrical devices which make the valve device 12 keep opening during the period Δ t after stopping the engine 1.

The advantage of the above first and second embodiments of a pressure control means according to the present invention are summarized as follows. It is not necessary to open the valve device 12 so as to allow evaporated fuel in the fuel tank 11 to be discharged into the canister 24 at a time of the engine stopping. This is because evaporated fuel in the fuel tank 11 has already been discharged in the engine 1 running state, that is, before stopping the engine 1, as mentioned above. The above mentioned saturation state of the canister 24 is not caused by sharp pressure variation in the fuel tank 11 as a result of the following reason.

The reason is that because of, for example, the above mentioned ebullition-under-reduced-pressure-state at the moment of allowing evaporated fuel in the tank 11 to be discharged into the canister 24 at the moment of the engine 1 stopping, evaporation of fuel in the tank 11 may almost stop as mentioned above. Thus, discharging of evaporated fuel into atmosphere through the canister is prevented and excess supply of fuel into the fuel tank due to an abnormal function of the above mentioned fuel-supply-excess-preventing-mechanism is also prevented. Abnormal function may occur due to the considerable period needed before stopping of evaporating of fuel as mentioned above.

Another advantage of the embodiments is described below. This is to make it possible to prevent a sharp increase of the pressure in the tank 11 soon after the engine 1 stops because the valve device 12 keeps open during the period Δ t after stopping the engine 1. Thus, leakage of evaporated fuel at a time of opening of the fuel-supply-cap of the tank 11 for supply of fuel into the tank 11 is prevented. These two advantages are vary useful practically.

A disadvantage of the embodiments mentioned above is described below. The predetermined period Δ t, determined depending on the diameter of the orifice 21*a* of the VTV 20 or the capacity of the vacuum tank 30, is constant period. Thus, there may be cases, these occurring because of various conditions of the engine 1, being described below. The first case is that the predetermined period Δ t may not be sufficiently long so that pressure in the tank 11 may increase undesirably after the valve device 12 closing because of the period Δ t elapsed. Second case is that the predetermined period Δ t may be excessively long so that fuel is supplied into the tank 11 during the period Δ t, that is, when the valve device 12 is open. Thus, excess supply of fuel into the tank 11 may occur. Both cases cause problems.

A general object of a third embodiment of a pressure control system according to the present invention described below is to overcome the problems. A particular object of the third embodiment is to provide a pressure control system having a feature described below. The predetermined period Δ t is controlled in response to pressure in the tank 11 in the third embodiment so that the predetermined period Δ t is controlled to be a period appropriately corresponding to various conditions of the engine 1. These conditions depend on a manner of using the engine 1. Thus, the pressure in the tank 11 can be controlled properly, this resulting in preventing an excess increase of pressure in the tank 11 and an excess supply of fuel into the tank 11.

Figure 7:
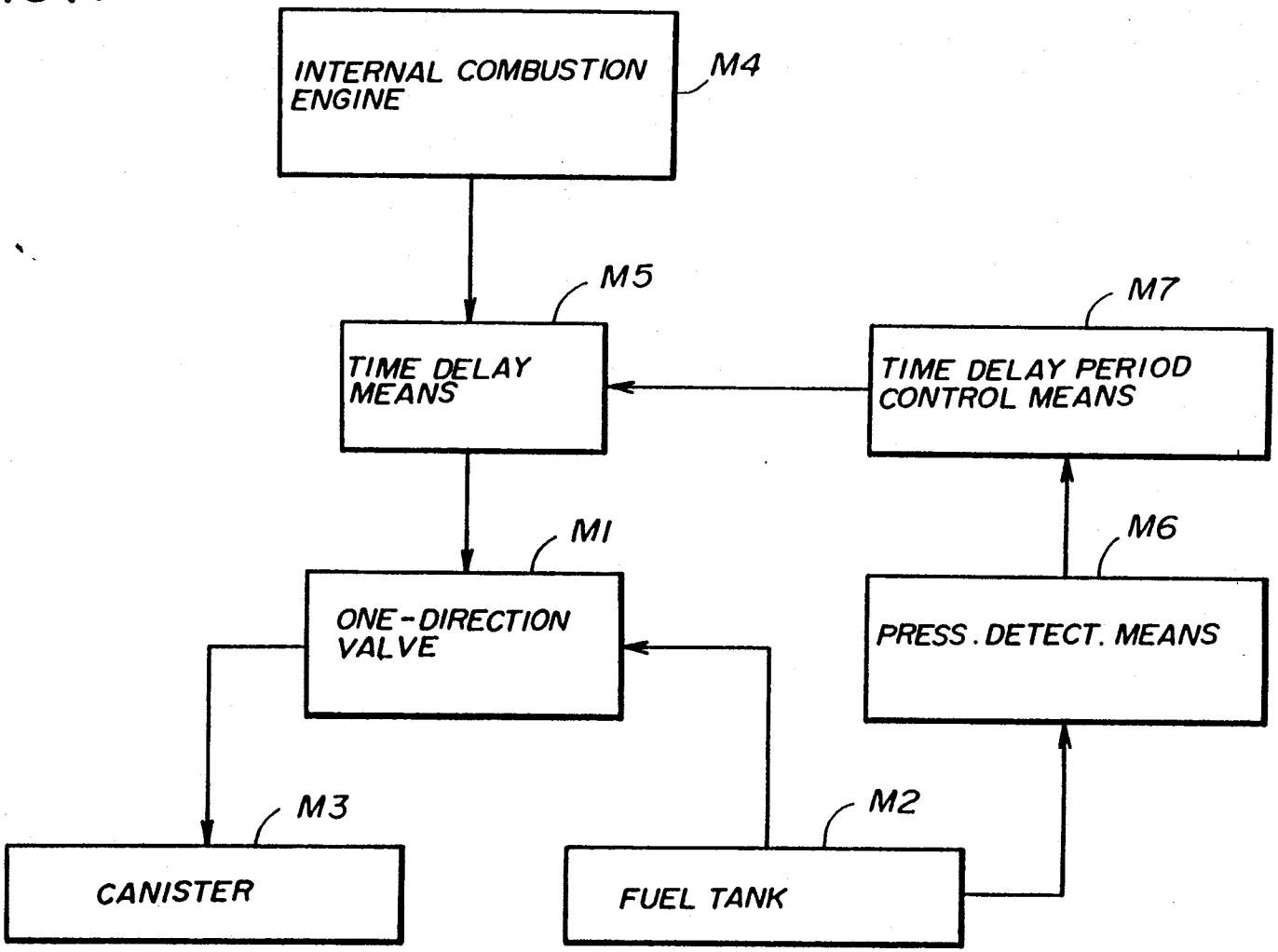
FIG. 7 shows a principle block diagram of the third and fourth embodiments.

A principle of the third embodiment is described below in conjunction with FIG. 7. An one-directional valve M1 is provided in a path connecting between a fuel tank M2 and a canister M3. The valve M1 opens during an engine M4 running state, and the valve M1 keeps open during a predetermined period Δ t elapsed after the engine M4 stopping moment. The valve M1 opens while pressure in the tank M2 is higher than a predetermined pressure P1, and the valve M1 closes otherwise. The predetermined period Δ t is determined by a time delay means M5 and the means M5 is controlled by a time delay period control means M7 so that the means controls the period Δ t in response to a pressure detecting signal provided by a pressure detecting means M6. The means M6 is connected with the tank M2 so as to detect pressure in the tank M2.

Figure 8:
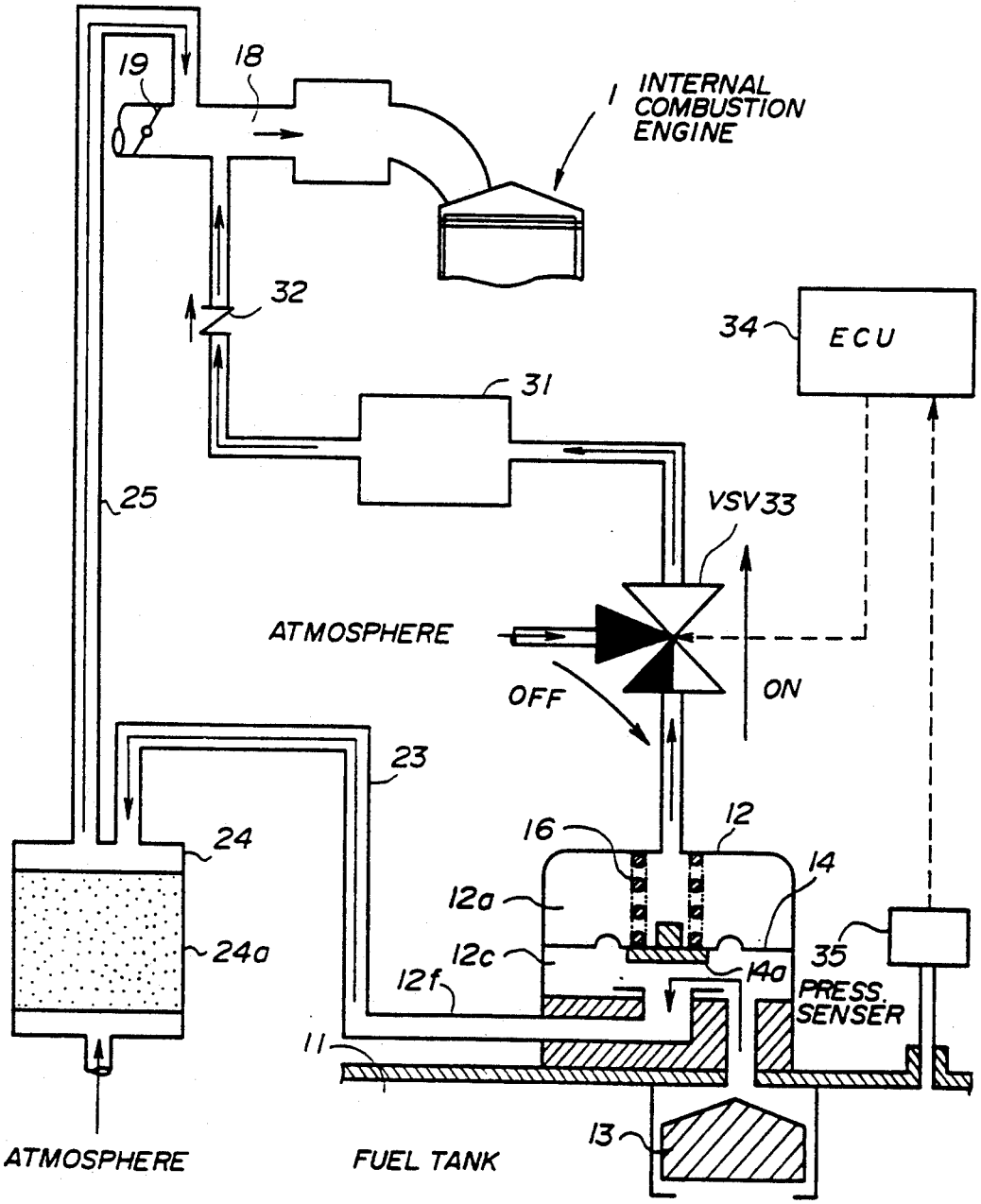
FIG. 8 shows a component diagram of the third and fourth embodiments.

A composition of the third embodiment of the pressure control system according to the present invention is described below in conjunction with FIG. 8. A description for parts of the third embodiment which are the same as parts of the first embodiment shown in FIG. 3, is omitted. The same numerals as those given to the parts of the first embodiment are also given to the corresponding parts of the second embodiment.

A valve device 12 serves as the above mentioned the one-directional valve M1. Air escapes from an electrical-controlled-vacuum-pressure-switching-valve (it is referred by "VSV" hereinafter) 33 into a portion of an intake path 18 on a downstream side of a throttle valve 19 through a check valve 32 and a vacuum tank 31. The VSV 33 comprises an electromagnetic valve and it is controlled by an electronic-control-unit (it is referred by "ECU" hereinafter) 34, and the ECU controls the VSV 33 in response to a pressure detecting signal provided from a pressure sensor 35 in the tank 11.

The VSV allows air to escape from a control cavity 12*a* of the valve device 12 into the vacuum tank 31 when the VSV is in an "ON" state because of a control signal provided by the ECU 34. on the other hank The VSV allows air to flow into the control cavity 12*a* from atmosphere when the VSV is in an "OFF" state because of another control signal provided by the ECU 34.

The ECU 34 provides the control signal into the VSV 33 during the engine 1 running state, the valve device 12 thus opening regardless of pressure in the tank 11 because of air escaping from the control cavity 12*a* into the vacuum tank 31. on the other hand the valve device 12 opens while the pressure in the tank 11 is higher than the pressure P1 and closes otherwise during the "OFF" state of the VSV because of the other control signal being provided from the ECU.

Figure 9:
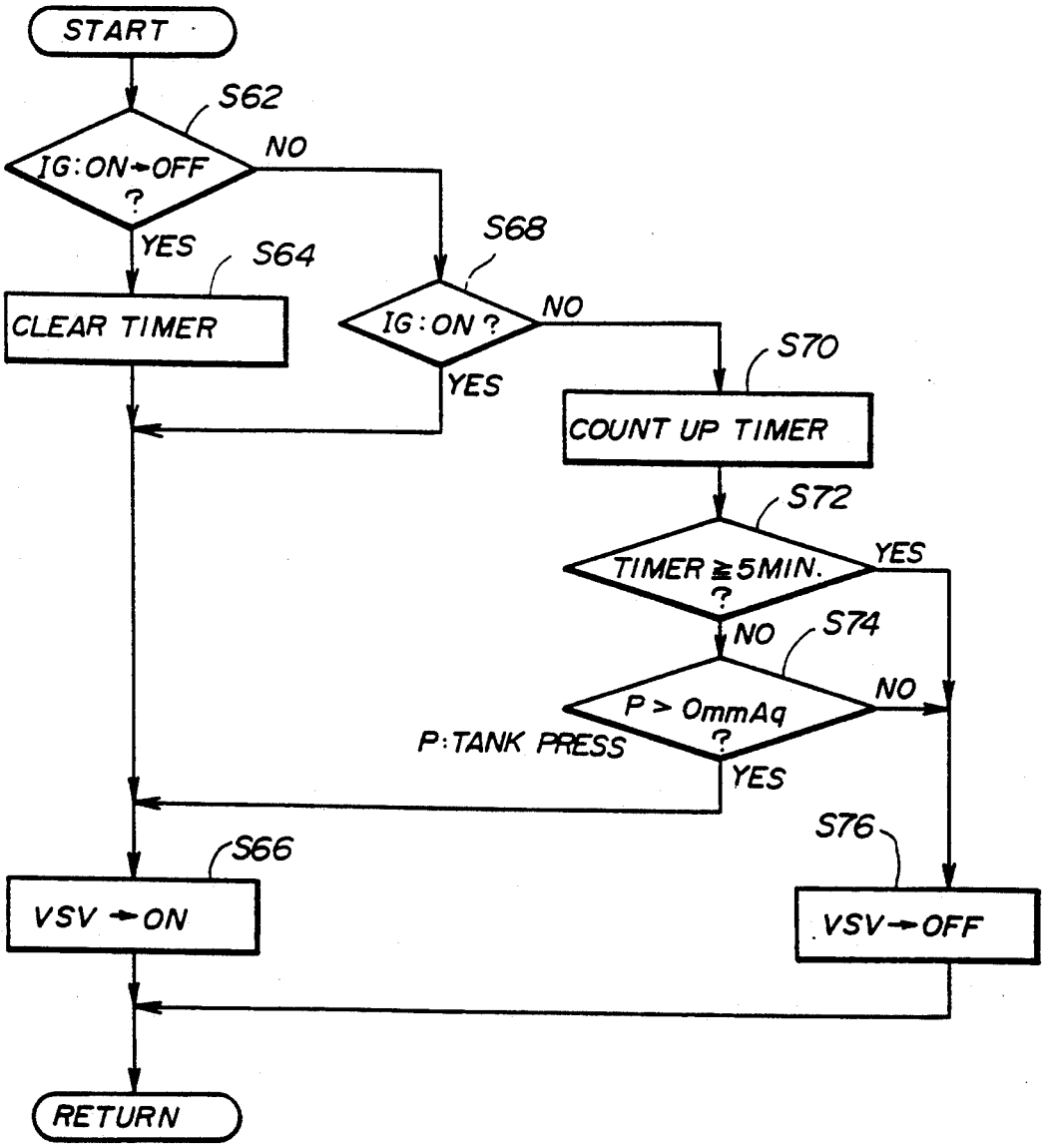
FIG. 9 shows a operation flow chart of an electronic-control-unit of the third embodiment.

An operation of the ECU 34 is described below in conjunction with FIG. 9. The operation shown in FIG. 9 is an interrupt operation repeated again and again at predetermined intervals.

States of an ignition switch of the engine 1 is supervised in S62. If the state thereof is changed from "ON" to "OFF" in the S62 because of the ignition switch being operated, a timer is cleared so that a counting thereof becomes "0" in S64. Thus, the VSV 33 is manipulated to be "ON" in S66, the operation of the ECU 34 at that time being thus finished.

If the state of the ignition switch is not changed from "ON" to "OFF" in the S62, its state is again supervised in S68. If the state is "ON", the VSV 33 is manipulated to be "ON" in the S66, the operation of the ECU 34 at that time is finished. If the state of the ignition switch is "OFF" in S68, the timer is counted up so that the counting thereof is incremented in S70.

After the step, the counting of the timer is supervised in S72. If the count is less than 5 minutes, that is a predetermined period Δ t, pressure in the tank 11 detected by the sensor 35 is supervised in S74. If the 20 pressure in the tank 11 is higher than 0 mm Ag (it is a second predetermined pressure) in the S74, the S66 is performed and the operation of the present time is finished. If the pressure is not higher than 0 mm Ag in the S74, or if the count is not less than 5 minutes in the S72, the VSV 33 is manipulated to be "OFF" in S76, the operation at that time is then finished.

Variations of the pressure in the tank 11, operation of the valve device 12, and the operation of the VSV 33 because of operation of the engine 1, that is that of the ignition switch according to the FIG. 9 as mentioned above are described below in conjunction with FIGS. 10A through 10D.

Figure 6:
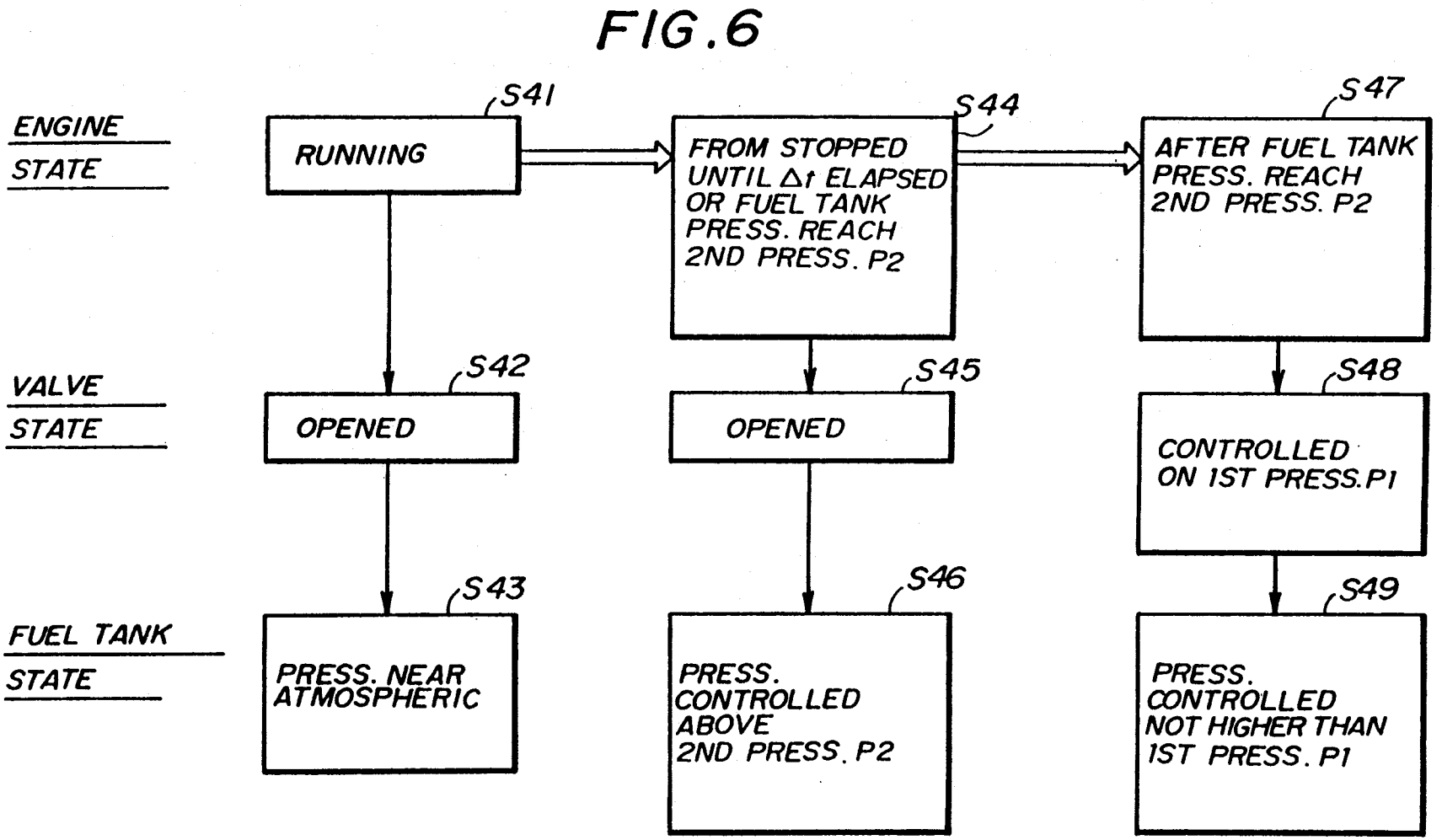
FIG. 6 shows a concept illustration for an operation of third and fourth embodiments of a pressure control system according to the present invention.
Figures 10A, 10B, 10C, 10D:
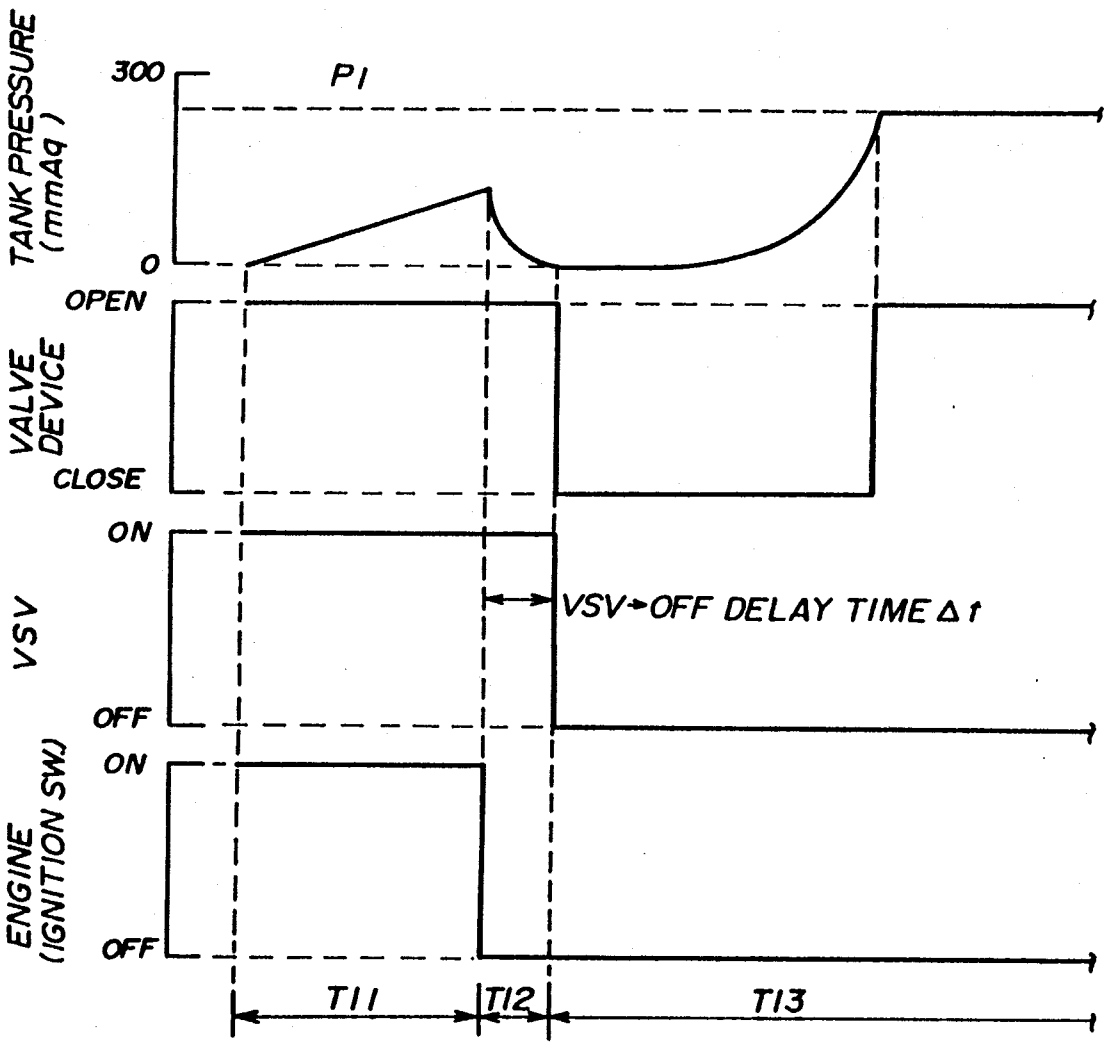
FIGS. 10A through 10D respectively show examples of timing charts of a pressure in a fuel tank of an engine, operations of valves, and a state of the engine concerning the third embodiment.

The VSV 33 keeps the "ON" state during the engine 1 running state, that is while the ignition switch is the "ON" state in T1l period as shown in FIGS. 10D and 10C, also shown in S41 in FIG. 6. Thus, air in the control cavity 12*a* escapes into the intake path 18 through the VSV 33, and the valve device 12 thus keeps an opening state as shown in FIG. 10B, also shown in S42 of FIG. 6. Thus, evaporated fuel (vapor) in the tank 11 is discharged into the canister 24 during that period. The pressure in the tank 11 increases gradually from the atmospheric pressure, the pressure in the tank 11 being not too far from the atmospheric pressure because of the valve device 12 opening as shown in FIG. 10A, also in S43 of FIG. 6.

Then after the ignition switch is changed from "ON" to "OFF", that is the engine 1 stops, it is a period T12 in FIGS. 10A through 10D. If the counting of the timer, being supervised, is within 5 minutes, the pressure in the tank 11 is supervised. If the pressure in the tank 11 has not decreased because of vapor evaporated in the tank 11 as shown in S44 of FIG. 6, the VSV 33 is manipulated to keep the "ON" state. This results in the valve device 12 keeping the opening state as shown in S45. This the valve device 12 keeping the opening state is realized because the vacuum pressure in the control cavity 12*a* of the valve device 12, which has been made by air escaping into the intake path 18 through the VSV 33, is kept by means of the check valve 32 and vacuum tank 31, which are provided between the intake path 18 and the VSV 33.

Then after the pressure in the tank 11 decreases to be 0 mm Ag because of minimizing of evaporation in the tank 11, or if the counting of the timer reaches 5 minutes, as shown at the end of the period T12 and beginning of the period T13 of FIG. 10A, also in S47 of FIG. 6, the VSV 33 is manipulated to be "OFF", this resulting in the valve device 12 closing as shown in FIG. 10C in the time.

Then after the predetermined period Δ t (5 minutes) has elapsed, it is the beginning of the period T13, and the VSV 33 is manipulated to be "OFF" as mentioned above so that the valve device 12 is beginning to be controlled so as to control the pressure in the tank 11 to be not more than the predetermined pressure P1 as shown in S48 and S49 of FIG. 6. This is because an evaporation of fuel in the tank 11 stops within several minutes, and the pressure in the tank 11 should be kept in a relatively high pressure state in the other period during the engine 1 stopped state, that is during the car being left. This keeping of the pressure in the tank 11 at high pressure during the period is in order to reduce an evaporation of fuel in the tank 11 so as to reduce the amount of evaporated fuel to be stored in the canister 24.

Then after the beginning of the period T13, in the engine stopped state, if a temperature in the tank 11 increases because of, for example, increase of atmospheric temperature resulting in evaporation of fuel, the pressure in the tank 11 increases as a result of the evaporation of fuel therein. As a result of this pressure increasing, if the pressure in the tank 11 reaches the pressure P1, the valve device 12 opens. This results in the vapor in the tank 11 being discharged into the canister.

Figure 11:
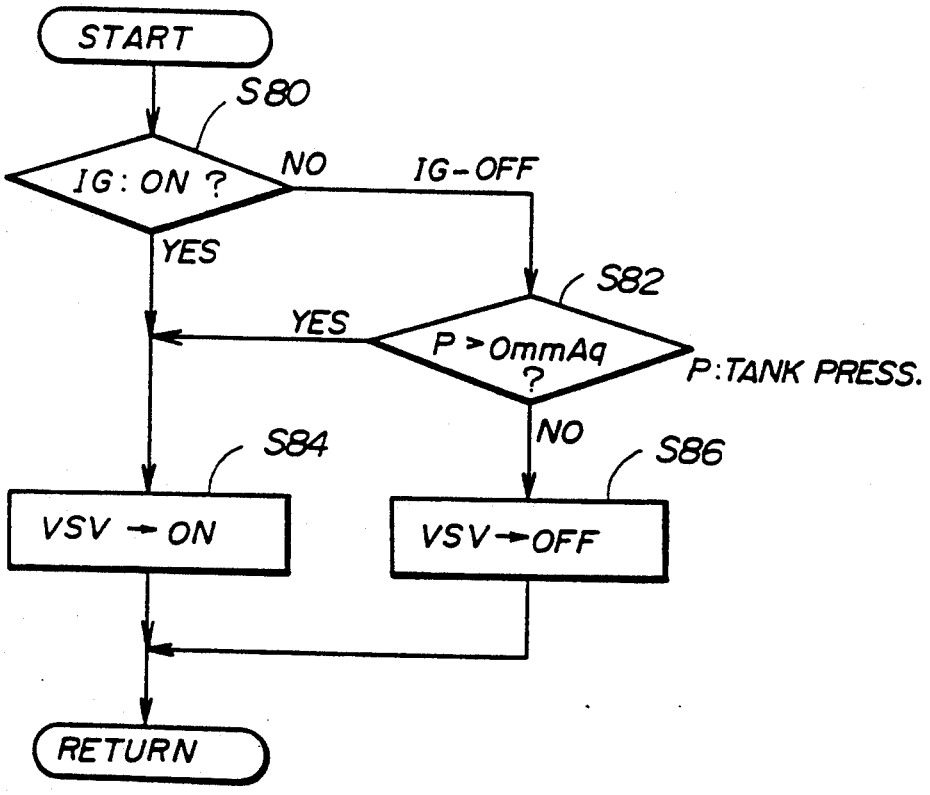
FIG. 11 shows a operation flow chart of the fourth embodiment.

A fourth embodiment of a pressure contro system according to the present invention is described below in conjunction with FIG. 11. A difference between the third embodiment as mentioned above and this fourth embodiment is that the timer incorporated in the operation of the ECU 34 of the third embodiment is omitted in the fourth embodiment.

The ECU 34 supervises whether the ignition switch is in the "ON" state or the "OFF" state in S80. If the state of the ignition switch is the "OFF" state in the S80, the pressure in the tank 11 is supervised to determine whether it is higher than 0 mm Ag or not in S82. If the ignition switch is the "ON" state in the S80, or if the pressure in the tank 11 is higher than 0 mm Ag in S82, the VSV 33 is manipulated to the "ON" state in S84. If the pressure in the tank 11 is not higher than 0 mm Ag in the S82, the VSV 33 is manipulated to the "OFF" state in S86.

The operation of the pressure control system of the fourth embodiment, as a result of the above mentioned operation of the ECU 34, is described below. After the pressure in the tank 11 reaches 0 mm Ag as a result of decreasing after stopping the engine 1, air flows into the control cavity 12*a* of the valve device 12 during the VSV 33. If the pressure in the tank 11 increases after the time, this may result in the VSV 33 being manipulated to the "ON" state in S82. However, the pressure in the vacuum tank 31 at this time has not become sufficiently negative because of the above mentioned once air flowing through the VSV 33. Thus, sufficient air cannot escape from the control cavity 12*a* into the vacuum tank 31, and the valve device 12 does not open even if the VSV 33 is in the "ON" state as a result of being manipulated in the S82 as mentioned above. Therefore, similar operation can be realized in the fourth embodiment. However, one problem in the fourth embodiment is that the ECU 34 manipulates the VSV 33 to the "ON" state during the pressure in the tank being a positive pressure in the S82 per each interrupt operation as shown in FIG. 11. This results in some magnitude of voltage signal being applied on the VSV 33 at the time.

Advantages obtained in the above mentioned third and fourth embodiments are described below. An excess increase of the pressure in the tank 11 soon after the engine stops can be prevented as a first advantage because the predetermined period Δ t can be so long that the evaporation of fuel in the tank 11 becomes minimal. Also an excess supply of fuel into the tank 11, which may occur if the predetermined time Δ t is unnecessarily long, can be prevented as a second advantage. This is because if an amount of vapor is relatively little, this results in rapidly reaching 0 mm Ag of the pressure in the tank 11 after the engine stops, the valve device closes even if it is within the period Δ t and does not open again unless the pressure increases to P1. These two advantages are very useful practically.

A feature of a fifth embodiment of a pressure control system according to the present invention is described below. The feature is that a pressure, on which an operation of the valve device depends, is switched depending on a state of the engine.

Figure 13:
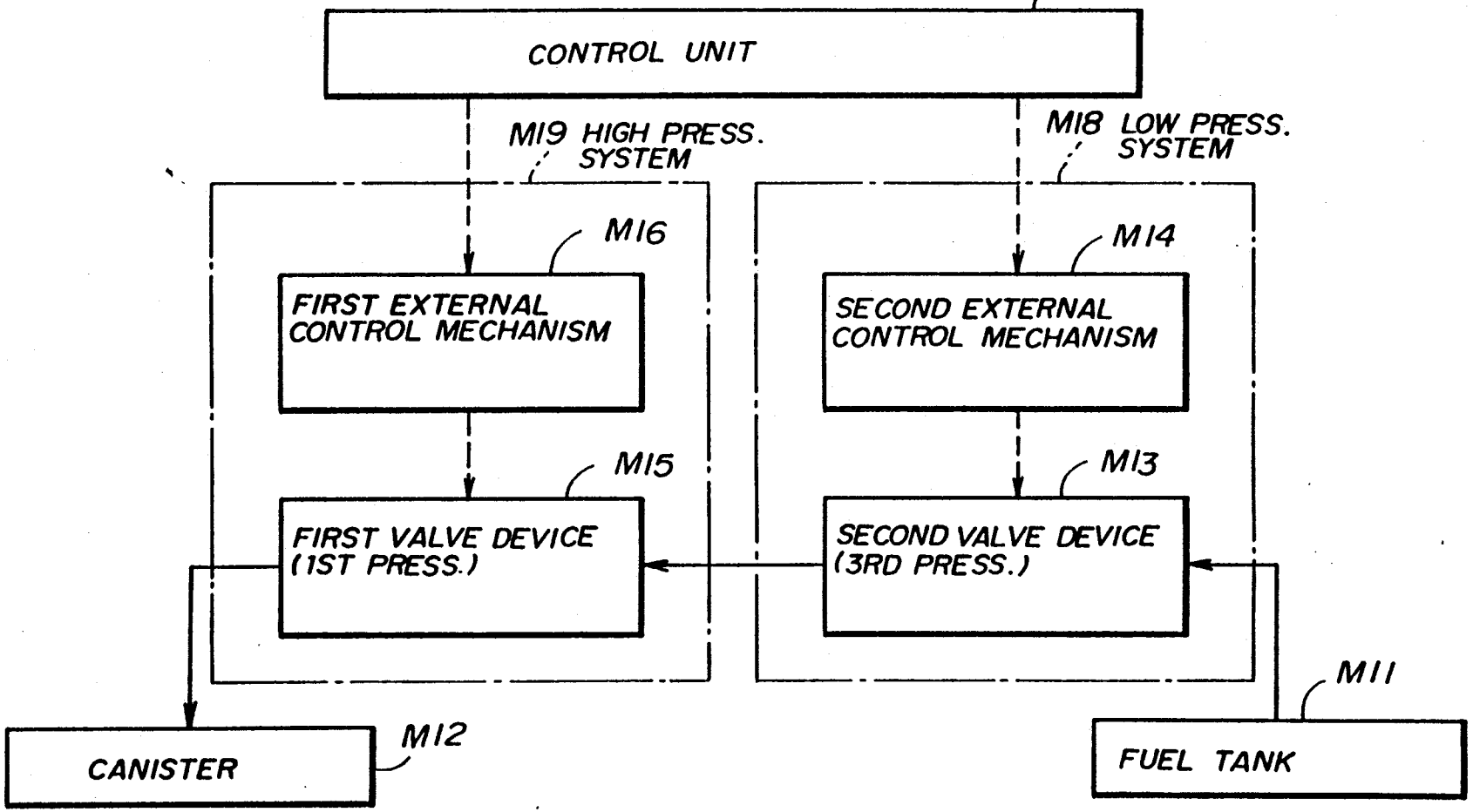
FIG. 13 shows a principle block diagram of the fifth embodiment.

A principle of the fifth embodiment is described below in conjunction with FIG. 13. The fifth embodiment is a pressure control system of an "evapo-purge system" for treating evaporated fuel in a fuel tank M11 so as to discharge it into a canister M12. The embodiment has a high pressure system M19 and a low pressure system M18. The high pressure system M19 has a first valve device M15 and a first external control mechanism M16. The low pressure system M18 has a second valve device M13 and a second external control mechanism M14.

The first valve device M15 and second valve device M13 are provided in series with each other in a path connecting between the tank M11 and the canister M12. The first valve device M15 allows vapor to pass when a pressure applied thereon is higher than a first predetermined pressure P1 or when a control is given by the external control mechanism M16 to allow it, and the device M15 prevents it otherwise. The second valve device M13 allows vapor to pass when a pressure applied thereon is higher than a third predetermined pressure P3 or when a control is given by the external control mechanism M14 to allow it, and the device M13 prevents it otherwise.

The external control mechanisms M16 and M14 are controlled by a control unit M17 respectively as follows. The control unit M17 makes the mechanism M16 control the valve device M15 so that the device M15 allows vapor discharged from the device M13 to be discharged into the canister M12 during the engine running state. The control unit M17 controls both mechanisms M16 and M14 so that both devices M15 and M13 allow vapor in the tank M11 to be discharged into the canister M12 during a predetermined period Δ t elapsed after the engine stopping moment.

Figure 12:
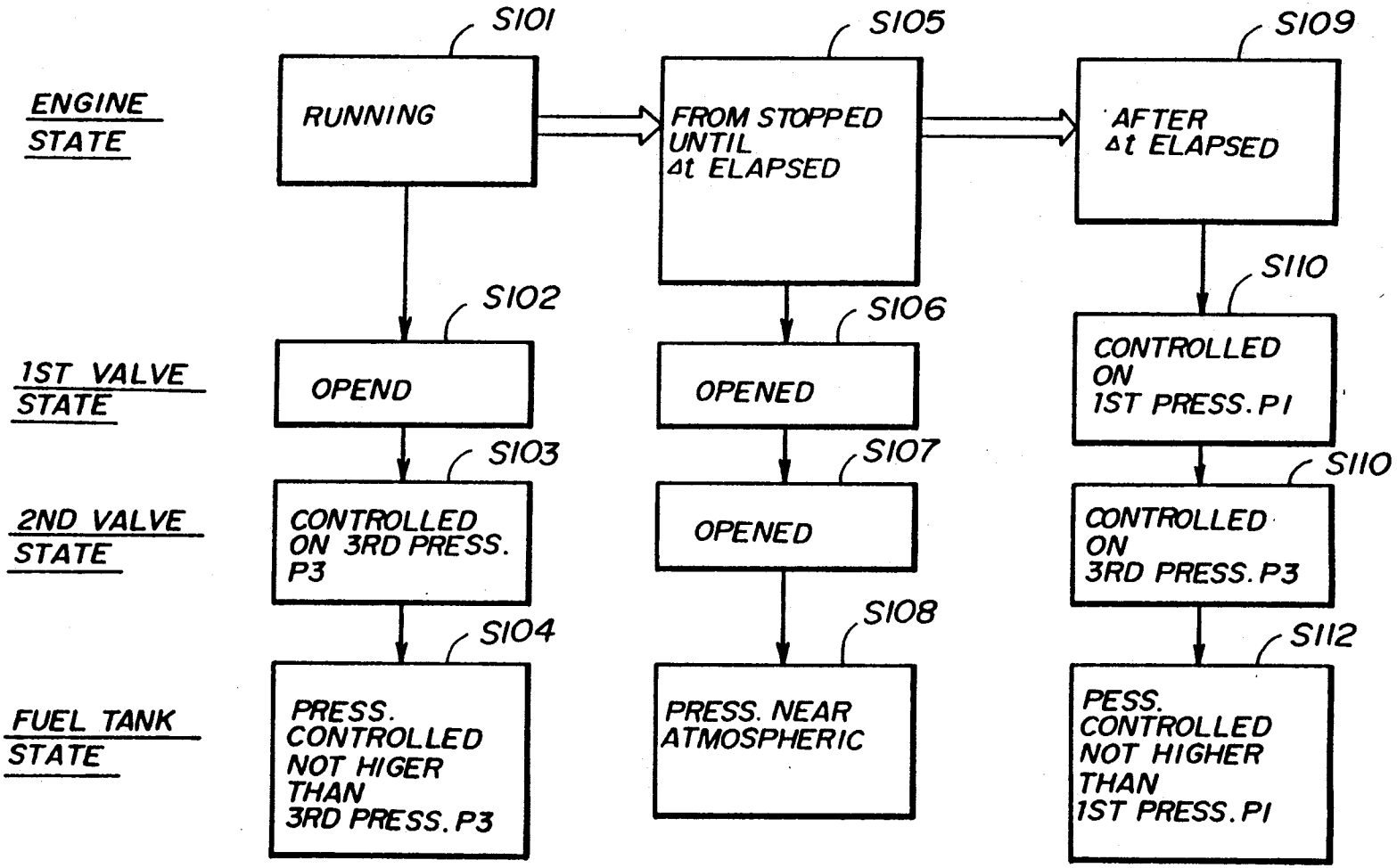
FIG. 12 shows a concept illustration for an operation of a fifth embodiment.

A function of the fifth embodiment having the above mentioned principle is described below in conjunction with FIG. 12. A pressure in the tank M11 is controlled to be not higher than the pressure P3 by means of the valve device M13 because of the valve device M15 allowing vapor to pass during the engine running state as shown in S101, S102, S103, and S104.

Vapor in the fuel tank M11 is discharged into the canister M12 during the period Δ t elapsed after the engine stopping moment because of both vave device M13 and M15 allowing vapor to pass as shown in S105, S106, and S107. Thus, the pressure in the tank M11 reduces to the atmospheric pressure from the pressure P3 as shown in S108. Therefore, the pressure in the tank M11 is prevented from varying sharply at a time when a fuel-supply-cap of the tank M11 is opened for supplying fuel.

Both valve devices M15 and M13 operate depending on pressures thereon after the period Δ t has elapsed in the engine stopped state as shown in S109, S110, and S111. Thus, the pressure in the tank M11 is controlled to be not higher than P1 substantially as shown in S112, where P1 is higher than the P3, by which P3 the pressure during the engine running state is limited.

Figure 14:
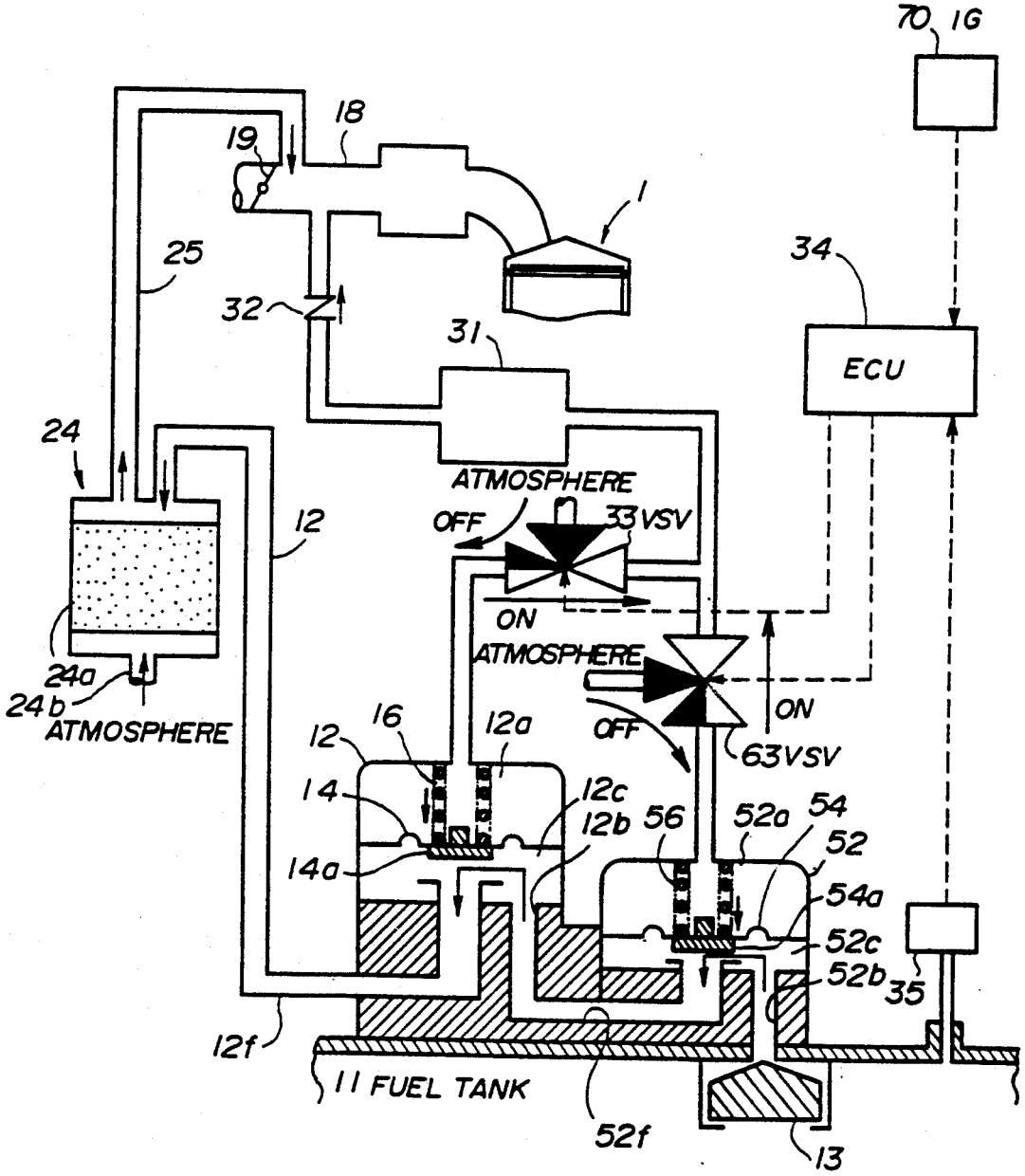
FIG. 14 shows a component diagram of the fifth embodiment.

A composition of the fifth embodiment of the pressure control system according to the present invention is described below in conjunction with FIG. 14. A description for parts of the fifth embodiment corresponding to the parts of the third and fourth embodiments shown in FIG. 8, which are substantially the same, is omitted. The same numerals as those given to the parts of the third and fourth embodiments are also given to the corresponding parts of the fifth embodiment.

A difference of the fifth embodiment from the third and fourth embodiments is described below. Another valve device 52 and an accompanied VSV 63 are added in the fifth embodiment. The valve 63 comprises an electromagnetic valve. The device 12 serves as the above mentioned first valve device M15 and the device 52 serves as the above mentioned second valve device M13. Also, the VSV 33 serves as the first external control mechanism M16 and the VSV 63 serves as the second external control mechanism M14.

The valve devices 52 is provided in a path between the inlet path 12*b* of the valve device 12 and the cut-off valve 13 of the tank 11. A connecting cavity 52*c* of the device 52 is connected with the bottom of the inlet path 12*b*. Further, an outlet port 52*f* of the valve device 52 is connected with the inlet path 12*b* of the valve device 12. Thus, the connecting cavity 12*c* of the valve device 12 is connected with the connecting cavity 52*c* of the valve device 52 in an opening state of the valve device 52, in which state the valve body 52*a* is positioned upward.

A composition of the device 52 is substantially the same as that of the device 12. The unit digit and a subscript of each numeral given to a corresponding part in the device 52 is given so as to be the same as that given to the respective part in the device 12 for the sake of clear correspondence between them. Thus, a description for the composition and function thereof is omitted. But a resilience of the compression spring 16 provided in the device 12 is stronger than that of the compression spring 56 in the device 52, that is, a pressure by which the valve device 12 opens is higher than a pressure by which the valve device 52 opens. Both compression springs 16 and 56 respectively push top surfaces of the valve bodies 14*a* and 54*a* in a down direction with the returning force. Also, the VSV 63 has the same composition and function as that of the VSV 33, a description thereof is thus omitted.

Air escapes from the vacuum tank 31 into the intake path 18 through the check valve 32 by the Bernoulli's effect in the engine 1 running state as mentioned above. Thus, a pressure in the vacuum tank 31 reduces into a vacuum pressure. The check valve 31 prevents air from flowing into the intake path 18 from the tank 31 during the engine 1 stopped state. Therefore, the pressure in the tank 31 can be kept at the vacuum pressure in the engine 1 stopped state.

It is possible to control the vave devices 12 and 52 regardless of pressures applied on bottom surfaces of the valve bodies 14*a*, and 54*a*. This is because the valve devices are opened if pressures in the control cavities 12*a* and 52*a* become negative pressures. Thus, the VSV 33 and 63, which are under a control of the ECU 34, control the devices 12 and 52 respectively so that the devices 12 and 52 open if air in the control cavities 12*a* and 52*a* escapes into the vacuum tank 31 through the VSV 33 and 63, which are in the "ON" states. Further operations of the device 12 and 52 are controled depending on pressures applied on the bottom surfaces of diaphragms of 14 and 54, central positions of which the valve bodies 14*a* and 54*a* are provided, if air flows into the control cavities 12*a* and 52*a* through the VSV 33 and 63, which are in the "OFF" states.

If both valve devices 12 and 52 open, vapor in the tank 11 is discharged into the canister 24 through the connecting cavities 52*c* and 12*c* of both devices 12 and 52 and the path 12, and otherwise the vapor is not discharged.

The vapor absorbed in the canister is purged into the intake path 18 with air escaping from an inlet path 24*b* of the canister during the engine 1 running states because of the above mentioned Bernoulli's effect by means of air flow in the intake path 18.

Operation of each parts in the fifth embodiment, the composition of which is described above, is described below in conjunction with FIG. 15, which shows the operation of the ECU 34, and FIGS. 16A through 16F, which show operation time charts.

Figure 15:
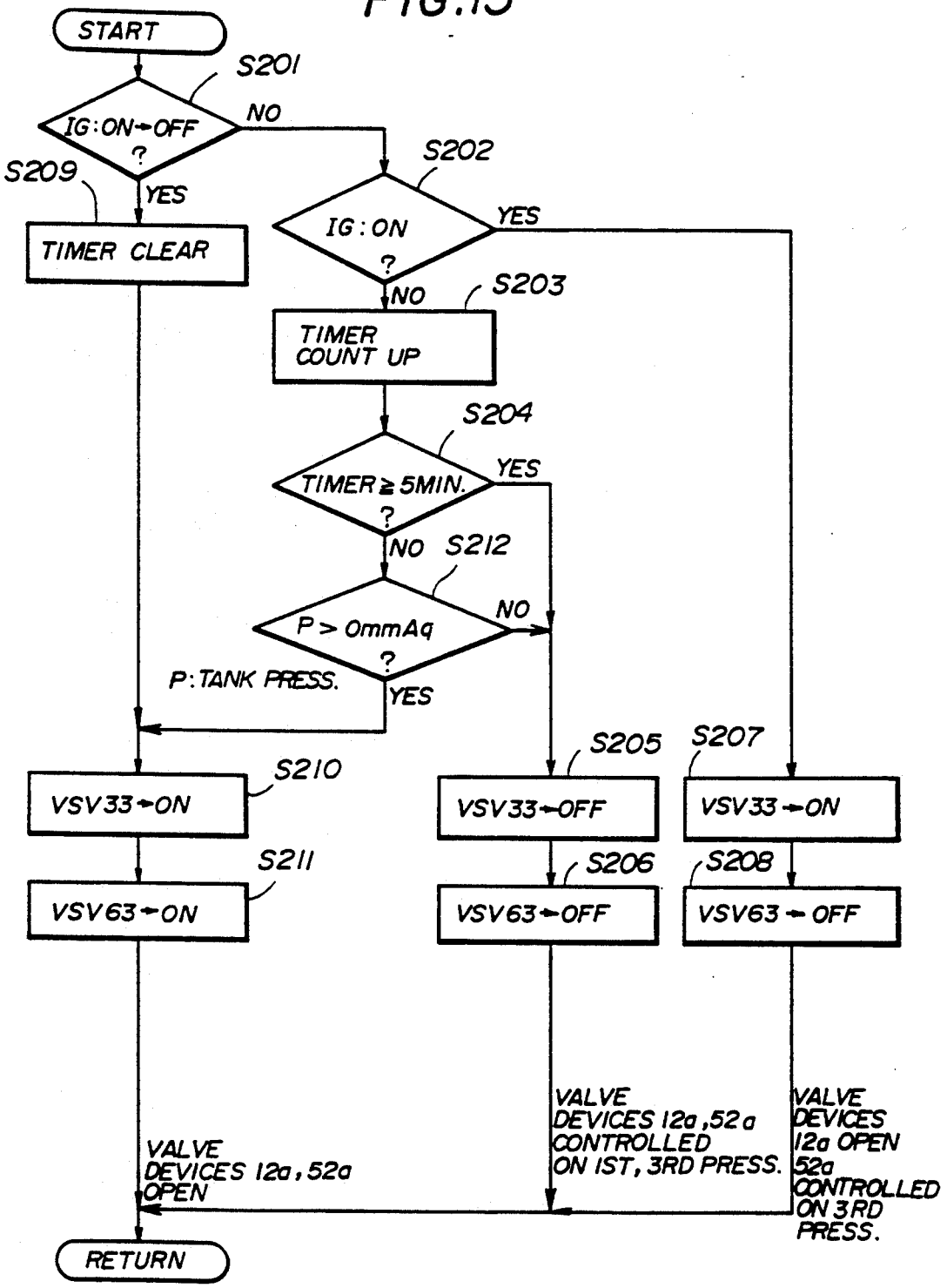
FIG. 15 shows an operation flow chart of a valve control routine executed by an electronic-control-unit of the fifth embodiment.

A valve control routine shown in FIG. 15 is started repeatedly again and again, with a predetermined intervals being provided between the times. It is supervised whether an ignition switch of the engine 1 is switched into an "OFF" state from an "ON" state or not in S201.

If the present period is in the engine stopped state as shown in a period T21 of FIGS. 16A through 16F, that is, the ignition switch (it is referred by "IG" hereinafter) in kept in an "OFF" state, S202 is then executed because the state of the IG is not switched into the "OFF" state from the "ON" state.

A state of the IG is supervised in S202. The state of the IG is the "OFF" state, then S203 is executed. A counting of a timer, which counts a time since stopping the engine 1, that is the above mentioned predetermined period $\Delta$ t, is incremented in the S203. Then S204 is executed.

The counting of the timer is supervised in the S204 as to whether it reaches 5 minutes or not. If it reaches 5 minutes in the S204, the VSV 33 is switched into an "OFF" state in S205. Then the VSV 63 is switched into an "ON" state in S206. Then the current routine is finished. The pressure in the tank 11 reaches the above mentioned predetermined pressure P1 as shown in the T21 of FIG. 16A.

If the engine 1 starts to run as shown in t21 of FIGS. 16A through 16F, S202 is executed after S201. The state of the IG is the "ON" state in S202, then S207 is executed. Thus the VSV 33 is switched into an "ON" state in the S207. Then the VSV 63 is kept in the "OFF" state in S208. Then the current routine is finished.

Figures 16A, 16B, 16C, 16D, 16E, 16F:
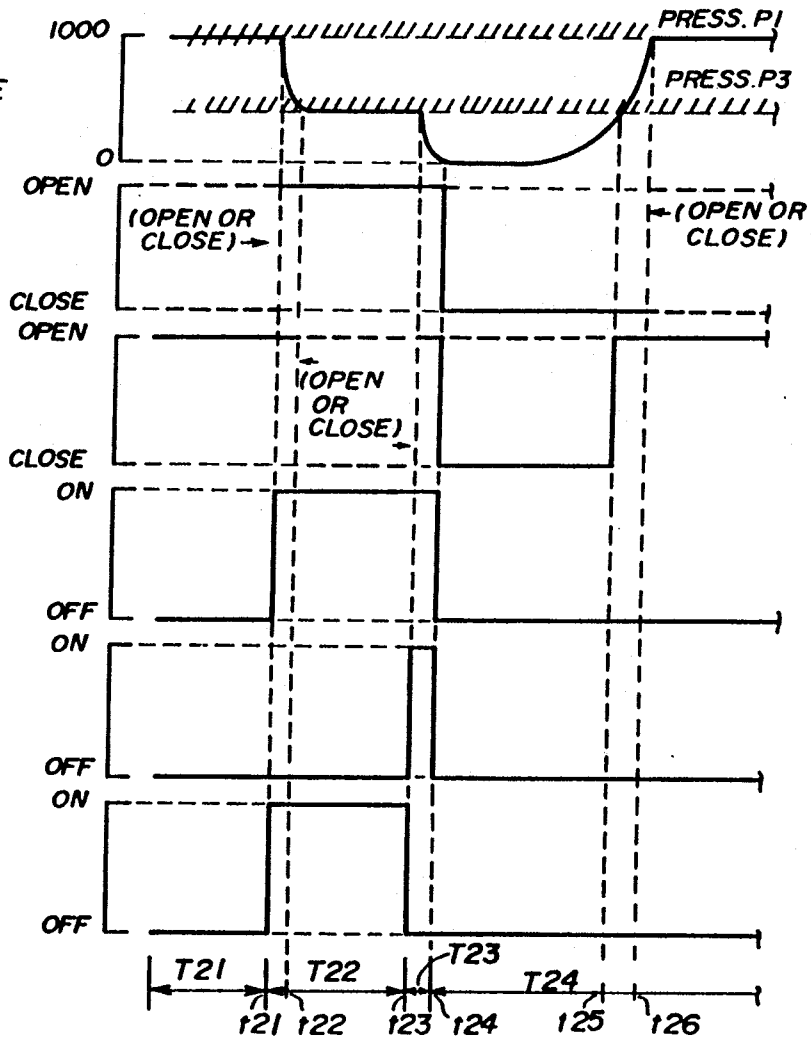
FIGS. 16A through 16F respectively show examples of timing charts of a pressure in a fuel tank of an engine, operations of valves, and a state of the engine concerning the fifth embodiment.

The above mentioned operation by the S201, S202, S207, and S208 is repeated during the engine running state as shown in T22 of FIGS. 16A through 16F. The valve device 12 keeps open during the period because the state of the VSV 33 is the "ON" state. Thus the pressure in the tank 11 reduces. Then the pressure reaches the above mentioned predetermined pressure P3 at a time t22 of FIGS. 16A through 16F. After the time t22, the operation of the valve device 52 depends on the pressure in the tank 11 as mentioned above so that the pressure in the tank 11 is controlled to be not higher than the pressure P3 as shown in FIG. 16A.

Then after the engine stops at a time t23, the S209 is executed after S201 because the state of the IG is turned to the "OFF" state from the "ON" state in the S201. Then the count of the above mentioned timer is cleared in S209. Then the VSV 33 keeps the "ON" state in S210. Then the VSV 63 is switched into the "ON" state in S211. Then the current routine is finished.

The state of the IG is kept in the "OFF" state in the in S201 at a next interrupt time of the routine during the engine stopped period begins after the time t23. Thus S202 is executed after S201. Then the count of the timer is incremented in the S203. Then if the count has not yet reached 5 minutes in the S204, the pressure in the tank 11 is supervised in S212 as to whether it has reduced to 0 mm Ag, that is the above mentioned second predetermined pressure P2. The pressure in the tank 11 is detected with the sensor 35. If the pressure is higher than 0 mm Ag, the S210, and the S211 are executed successively.

The above mentioned operation by the S201, S202, S203, S204, S212, S210, and S211 is repeated until the count of the timer reaches 5 minutes or the pressure in the tank 11 reaches 0 mm Ag, this period corresponding to a period T23. Both valve devices 12 and 52 open because the states of both VSV 33 and 63 are "ON" during the period T23 as shown in FIGS. 16B through 16E. Thus, vapor in the tank 11 is discharged into the canister. Therefore the pressure in the tank 11 reduces nearing 0 mm Ag as shown in FIG. 16A.

If the pressure in the tank 11 reaches 0 mm Ag as shown in t24, or the counting of the timer reaches 5 minutes, the S205, and the S206 are successively executed after the S204 or the S212. The above mentioned operation by the S201, S202, S203, S204, S205, and S206 is repeated until the engine 1 is started again. This period corresponds to T24.

The pressure in the tank 11 increases as a result of evaporation of fuel during the period T24. Then after the pressure exceeds the P3, the valve device 52, operation of which depends on a pressure applied on the bottom surface of the valve body 54*a* of thereof, that is the pressure in the tank 11, closes as shown in FIG. 16C at a time t25. Then the pressure further increases, thus reaching the P1 at a time t26. Then after it reaches P1, the pressure is controlled by the valve device 12, the operation of which depends on a pressure applied on the bottom surface of the valve body 14*a*, that is the pressure in the tank 11 transferred through the connecting cavity 52*c* of the device 52. This control is so that the pressure in the tank 11 is controlled to be not higher than the P1 as shown in FIG. 16A after the time t26. Vapor in the tank 11 is not discharged into the canister until the pressure reaches the P1.

First advantage of the above mentioned fifth embodiment of a pressure control system according to the present invention is described below. Vapor absorbed in the canister 24 can be purged into the intake path 18 during a period of the engine running state by the above mentioned Bernoulli's effect by means of air flow therein. An upper-limit pressure in the tank 11, on which the operation of the valve device 12 or 52 depends, is relatively low, that is the P3, during the above mentioned period. Thus, a relatively large amount of vapor in the fuel tank, because of this relatively low upper-limit pressure, can be purged into the intake path 18 through the canister 24. Further, it is possible to discharge vapor soon after the engine stops without a sharp variation of the pressure in the tank 11 because of the relatively low upper-limit pressure of the tank 11.

On the other hand, vapor absorbed in the canister 24 cannot be purged into the intake path 18 during a period of the engine stopped state because none of the air flows in the intake path 18. Another upper-limit pressure in the tank 11, on which the operation of the valve device 12 or 52 depends, is relatively high, that is the P1, during the above mentioned period. Thus, it is possible to reduce an amount of vapor in the tank 11 because of the relatively high upper-limit pressure in the tank 11. Therefore it can be prevented that so much vapor is discharged into the canister as to saturate the capacity of the canister, this resulting in leakage of vapor into the atmosphere.

A second advantage of the fifth embodiment of a pressure control system according to the present invention is described below. It is possible to determine the desirable upper-limit pressure in the tank 11 for the engine running state and for engine stopped state. Thus, it is possible to determine them to correspond to a strength, a durability, a shape, a thermal circumferential condition and other conditions regarding each tank. Therefore an optimum "evapo-purge system" can be provided.

Methods of operation of the valve devices 12 and 52 are not necessarily limited into those described above such that both valve devices 12 and 52 close at the time of the engine stopping. It is possible to apply methods of operation thereof to the other embodiment of a pressure control system according to the present invention. The methods of operation are described below. An operation of the valve device 52 depends on the pressure in the tank 11 and the valve device 12 opens as a result of the VSV 33 being in the "ON" state during the period of the engine running state. As a result of these operations, the upper-limit pressure in the tank 11 is P3 during the period as shown in FIG. 16A during the T22. on the other hand, an operation of the valve device 12 depends on the pressure in the tank 11 and the valve device 52 opens as a result of the VSV 63 being in the "ON" state during the engine stopped state. As a result of these operations, the upper-limit pressure in the tank 11 is P1 during the period as shown in FIG. 16A during the T24.

Further, the present invention is not limited to these preferred embodiments, and various variations and modifications may be made without departing from the scope of the present invention.

What is claimed is:

1. A pressure control system comprising:

a pressure control means for allowing evaporated fuel in an fuel tank of an engine to be discharged to a canister during the engine running state, the canister absorbing the evaporated fuel; the pressure control means continuing to allow evaporated fuel in the fuel tank to be discharged to the canister after the engine stops until a predetermined period has elapsed, Δ the pressure control means allowing evaporated fuel in the fuel tank to be discharged to the canister while a pressure in the fuel tank is higher than a first predetermined pressure after the predetermined period has elapsed in the engine stopped state, the pressure control means preventing evaporated fuel in the fuel tank from being discharged to the canister when a pressure in the fuel tank is lower than the first predetermined pressure after the predetermined period has elapsed in the engine stopped state.

2. The pressure control system according to claim 1, wherein:

the pressure control means comprises:

a first valve for allowing evaporated fuel in the fuel tank to pass through a first path during a vave open state thereof, or the first valve preventing evaporated fuel in the fuel tank from passing through the first path during a valve closed state thereof, the first valve being provided in the first path, the first path connecting between the fuel tank and the canister; and first control means for opening the first valve during an engine running state, the first control means keeping the valve open state of the first valve until the predetermined period has elapsed after the engine stops, the first control means opening the first valve while a pressure in the fuel tank is higher than the first predetermined pressure after the predetermined period elapsed in the engine stopped state, the first control means closing the first valve while a pressure in the fuel tank is lower than a first predetermined pressure after the predetermined period has elapsed in the engine stopped state.

3. The pressure control system according to claim 2, wherein:

the first valve comprises a diaphragm valve having a diaphragm;

the first control means has a control cavity and a connecting cavity, the diaphragm separating both cavities, the control cavity being located in a side of a valve opening direction, the connecting cavity being located in a side of a valve closing direction, the connecting cavity being connected into the fuel tank, the connecting cavity being connected into the canister during the valve opening state, the diaphragm being pressed to the valve opening direction by means of a pressure in the fuel tank, the first control means further having a pressing means for pressing the diaphragm valve in the valve closing direction;

the first control means comprises external control means for making a pressure in the control cavity be negative pressure during the engine running state, the external control means making the pressure in the control cavity near atmospheric pressure gradually after the engine stops; and the first control means opens the first valve whie the pressure in the control cavity is negative pressure, the first control means opens the first valve while the pressure in the fuel tank is higher than the first predetermined pressure in a condition of the pressure in the control cavity being atmospheric pressure, or the first control means closes the first valve when the pressure in the fuel tank is lower than the first predetermined pressure for the condition of the pressure in the control cavity being atmospheric pressure.

4. The pressure control system according to claim 3, wherein the external control means comprises an orifice and a check valve, both being provided in parallel to each other in a second path, the second path connecting an air intake path of the engine and the control cavity, the check valve allowing fluid pass therethrough from the control cavity to the air intake path, the pressure in the control cavity being negative pressure as a result of absorption of fluid therein through the check valve due to the Bernoulli's effect by means of air flow in the air intake path in the engine running state, the pressure in the control cavity nearing atmospheric pressure gradually as a result of gradual absorption of air through the orifice from the air intake path in the engine stopped state.

5. The pressure control system according to claim 4, wherein the external control means comprises a period adjustment tank having a predetermined capacity, the period adjustment tank being provided in series with the orifice and the check valve in the second path.

6. The pressure control system according to claim 1, wherein the pressure control means comprises period control means for controlling the predetermined period depending on the pressure in the fuel tank.

7. The pressure control system according to claim 6, wherein the pressure control means allows evaporated fuel evaporated in the fuel tank to be discharged to the canister during the engine running state, the pressure control means continues allowing evaporated fuel in the fuel tank to be discharged to the canister after the engine stops until the pressure in the fuel tank reaches a second predetermined pressure as a result of lowering of the pressure, the second predetermined pressure being lower than the first predetermined pressure, the pressure control means allows evaporated fuel in the fuel tank to be discharged to the canister when the pressure in the fuel tank is higher than the first predetermined pressure after the pressure in the fuel tank reaches the second predetermined pressure as a result of lowering of the pressure in the engine stopped state, or the pressure control means prevents evaporated fuel in the fuel tank from being discharged to the canister while the pressure in the fuel tank is lower than the first predetermined pressure after the pressure in the fuel tank reaches the second predetermined pressure as a result of lowering of the pressure in the engine stopped state.

8. The pressure control system according to claim 7, wherein the pressure control allows evaporated fuel in the fuel tank to be discharged to the canister during the engine running state, the pressure control means continues allowing evaporated fuel in the fuel tank to be discharged to the canister after the engine stops until either the time when the predetermined period elapses or the time when the pressure in the fuel tank reaches a second predetermined pressure as a result of lowering of the pressure, whichever time is earlier, the pressure control means allow evaporated fuel in the fuel tank to be discharged to the canister while the pressure in the fuel tank is higher than the first predetermined pressure after the above mentioned earlier time in the engine stopped state, or the pressure control means prevents evaporated fuel in the fuel tank from being discharged to the canister while the pressure in the fuel tank is lower than the first predetermined pressure after the above mentioned earlier time in the engine stopped state.

9. The pressure control system according to claim 8, wherein the pressure control means comprises:

a first valve for allowing evaporated fuel in the fuel tank to pass through a first path during a valve opening state thereof, or the first valve preventing evaporated fuel in the fuel tank from passing through the first path during a valve closed state thereof, the first valve being provided in the first path, the first path connecting between the fuel tank and the canister; and a first control means for opening the first valve during the engine running state, the first control means keeping the valve open state of the first valve after the engine stops until either the time when the predetermined period elapses or the time when the pressure in the fuel tank reaches a second predetermined pressure as a result of lowering of the pressure, whichever time is earlier, the first control means opening the first valve while the pressure in the fuel tank is higher than the first predetermined pressure after the above mentioned earlier time in the engine stopped state, or the first control means closing the first valve during the pressure in the fuel tank being lower than the first predetermined pressure since the above mentioned earlier time in the engine stopped state.

10. The pressure control system according to claim 9, wherein:

the first valve comprises a diaphragm valve having a diaphragm;

the first control means has a control cavity and a connecting cavity, the diaphragm separating both cavities, the control cavity being located in a side of a valve opening direction, the connecting cavity being located in a side of a valve closing direction, the connecting cavity being connected into the fuel tank, the connecting cavity being connected into the canister in the valve opening state, the diaphragm being pressed to the valve opening direction by means of a pressure in the fuel tank, the first control means further having a pressing means for pressing the diaphragm valve in the valve closing direction;

the first control means comprises external control means for making a pressure in the control cavity be negative pressure during the engine running state, the external control means making the pressure in the control cavity near atmospheric pressure at either the time when the predetermined period elapses or the time when the pressure in the fuel tank reaches the second predetermined pressure as a result of lowering of the pressure, whichever time is ealier; and the first control means opens the first valve when the pressure in the control cavity is negative pressure, the first control means opens the first valve when the pressure in the fuel tank is higher than the first predetermined pressure for a condition of the pressure in the control cavity being atmospheric pressure, or the first control means closes the first valve when the pressure in the fuel tank is lower than the first predetermined pressure for the condition of the pressure in the contro cavity being atmospheric pressure.

11. The pressure control system according to claim 10, wherein the external control means comprises a second path and an electromagnetic valve, the second path connecting an air intake path of the engine and the control cavity, the electromagnetic valve being provided in the second path, and the electromagnetic valve being controlled by an electronic-control-unit.

12. The pressure control system according to claim 1, wherein:

the pressure control means allows evaporated fuel in the fuel tank to be discharged to the canister when the pressure in the fuel tank is higher than a third predetermined pressure in the engine running state, the pressure control means prevents evaporated fuel in the fuel tank from being discharged to the canister while the pressure in the fuel tank is lower than a third predetermined pressure in the engine running state, the third predetermined pressure being lower than the first predetermined pressure; the pressure control means keeps allowing evaporated fuel in the fuel tank to be discharged to the canister after the engine stops until a predetermined period has elapsed; the pressure control means allows evaporated fuel in the fuel tank to be discharged to the canister while a pressure in the fuel tank is higher than the first predetermined pressure after the predetermined period has elapsed in the engine stopped state, or the pressure control means prevents evaporated fuel in the fuel tank from being discharged to the canister while a pressure in the fuel tank is lower than the first predetermined pressure after the predetermined period elapsed in the engine stopped state.

13. The pressure control system according to claim 12, wherein:

the pressure control means allows evaporated fuel in the fuel tank to be discharged to the canister while the pressure in the fuel tank is higher than a third predetermined pressure in the engine running state, the pressure control means prevents evaporated fuel in the fuel tank from being discharged to the canister while the pressure in the fuel tank is lower than a third predetermined pressure in the engine running state, the third predetermined pressure being lower than the first predetermined pressure; the pressure control means continues allowing evaporated fuel in the fuel tank to be discharged to the canister after the engine stops until either the time when the predetermined period elapses or the time when the pressure in the fuel tank reaches a second predetermined pressure as a result of lowering of the pressure, whichever time is earlier, the second predetermined pressure being lower than the third predetermined pressure; the pressure control means allows evaporated fuel in the fuel tank to be discharged to the canister while a pressure in the fuel tank is higher than the first predetermined pressure after the above mentioned earlier time in the engine stopped state, or the pressure control means prevents evaporated fuel in the fuel tank from being discharged to the canister while a pressure in the fuel tank is lower than the first predetermined pressure after the above mentioned earlier time in the engine stopped state.

14. The pressure control system according to claim 13, wherein the pressure control means comprises:

a first valve for allowing evaporated fuel in the fuel tank to pass through a first path during a valve open state thereof in a second valve open state, or the first valve preventing evaporated fuel in the fuel tank from passing through the first path during a valve closed state thereof, the first valve being provided in the first path, the first path connecting between the fuel tank and the canister;

first control means for opening the first valve during the engine running state; the first control means keeping the valve open state of the first valve after the engine stops until either the time when the predetermined period elapses or the time when the pressure in the fuel tank reaches the second predetermined pressure as a result of lowering of the pressure, whichever time is ealier; the first control means opening the first valve while the pressure in the fuel tank is higher than the first predetermined pressure after the pressure in the fuel tank reaches the second predetermined pressure as a result of lowering of the pressure, or the first control means closing the first valve while the pressure in the fuel tank is lower than the first predetermined pressure after the pressure in the fuel tank reaches the second predetermined pressure as a result of lowering of the pressure;

the second valve for allowing evaporated fuel to pass through the first path during a valve open state thereof in the first valve open state, or the second valve preventing evaporated fuel from passing through the first path during a valve closed state thereof, the second valve being provided in the first path in series to the first valve, and the second control means keeping the opening state of the second valve after the engine stops until either the time when the predetermined period elapses or the time when the pressure in the fuel tank reaches a second predetermined pressure, whichever is ealier; the second control means opening the second valve while the pressure in the fuel tank is higher than the third predetermined pressure after the above mentioned earlier time in the engine stopped state or in the engine running state, or the second control means closing the second valve while the pressure in the fuel tank is lower than the third predetermined pressure after the above mentioned earlier time in the engine stopped state or in the engine running state.

15. The pressure control system according to claim 14, wherein:

the first valve comprises a diaphragm valve having a first diaphragm;

the first control means has a first control cavity and a first connecting cavity, the first diaphragm separating the both cavities, the first control cavity being located on a side of the first valve opening direction, the first connecting cavity being located on a side of the first valve closing direction, the first connecting cavity being connected into the canister in the first valve open state, the first control means further having a pressing means for pressing the first valve in the first valve closing direction;

the second valve comprises a diaphragm valve having a second diaphragm;

the second control means has a second control cavity and a second connecting cavity, the second diaphragm separating the both cavities, the second control cavity being located on a side of the second valve opening direction, the second connecting cavity being located on a side of the second valve closing direction, the second connecting cavity being connected into the fuel tank, the second connecting cavity being connected into the first connecting cavity in the second valve open state, the first diaphragm being pressed in the first valve opening direction by means of a pressure in the second connecting cavity in the second valve open state, the second diaphragm being pressed in the second valve opening direction by means of the pressure in the fuel tank, the second control means further having a pressing means for pressing the second valve in the second valve closing direction;

the second control means comprises second external control means for making a pressure in the second control cavity be atmospheric pressure in the engine running state; the second external control means for making a pressure in the second control cavity be negative pressure after the engine stops until the above mentioned earlier time; the second external control means making the pressure in the second control cavity be atmospheric pressure at the above mentioned earlier time;

the second control means opens the second valve while the pressure in the fuel tank is higher than the third predetermined pressure for a condition of the pressure in the second control cavity being atmospheric pressure, the second control means closes the second valve while the pressure in the fuel tank is lower than the third predetermined pressure for the condition of the second control cavity being atmospheric pressure; the second control means opens the second valve while the pressure in the second control cavity is negative pressure;

the first control means comprises first external control means for making a pressure in the first control cavity be negative in the engine running state or after the engine stops until the above mentioned earlier time; the first external control means makes a pressure in the first control cavity be atmospheric pressure after the above mentioned earlier time in the engine stopped state;

the first control means opens the first valve while the first control cavity is negative pressure; the first control means opens the first valve while the pressure in the fuel tank is higher than the first predetermined pressure for a condition of the pressure in the first control cavity being atmospheric pressure in the second valve open state, the first control means closes the first valve while the pressure in the fuel tank is lower than the first predetermined pressure for the condition of the first control cavity being atmospheric pressure in the second valve open state.

16. A pressure control method comprising steps of:

(a) allowing evaporated fuel in an fuel tank of an engine to be discharged to a canister during the engine running state, the canister absorbing the evaporated fuel;

(b) continuing to allow evaporated fuel in the fuel tank to be discharged to the canister after the engine stops until a predetermined period has elapsed;

(c-1) allowing evaporated fuel in the fuel tank to be discharged to the canister while a pressure in the fuel tank is higher than a first predetermined pressure after the predetermined period has elapsed;

(c-2) preventing evaporated fuel in the fuel tank from being discharged to the canister while a pressure in the fuel tank is lower than the first predetermined pressure after the predetermined period has elapsed.

17. The pressure control method according to claim 16, wherein:

the step (b) continuing to allow evaporated fuel in the fuel tank to be discharged to the canister after the engine stops until the pressure in the fuel tank reaches a second predetermined pressure as a result of lowering the pressure, the second predetermined pressure being lower than the first predetermined pressure;

the step (c-1) allows evaporated fuel in the fuel tank to be discharged to the canister while the pressure in the fuel tank is higher than the first predetermined pressure after the pressure in the fuel tank reaches the second predetermined pressure as a result of lowering of the pressure;

the step (c-2) prevents evaporated fuel in the fuel tank from being discharged to the canister while the pressure in the fuel tank is lower than the first predetermined pressure after the pressure in the fuel tank reaches the second predetermined pressure as a result of lowering of the pressure.

18. The pressure control method according to claim 17, wherein:

the step (b) continues to allow evaporated fuel in the fuel tank to be discharged to the canister after the engine stops until either the time when the predetermined period elapses or the time when the pressure in the fuel tank reaches a second predetermined pressure as a result of lowering of the pressure, whichever is ealier; and the step (c-1) allows evaporated fuel in the fuel tank to be discharged to the canister while the pressure in the fuel tank is higher than the first predetermined pressure after the above mentioned earlier time in the engine stopped state; or the step (c-2) prevents evaporated fuel in the fuel tank from being discharged to the canister while the pressure in the fuel tank is lower than the first predetermined pressure after the above mentioned earlier time in the engine stopped state.

19. The pressure oontrol method aooording to claim 16, wherein:

the step (a) comprises:

(a-1) allows evaporated fuel in the fuel tank to be discharged to the canister while the pressure in the fuel tank is higher than a third predetermined pressure in the engine running state, the third predetermined pressure being lower than the first predetermined pressure; or (a-2) prevents evaporated fuel in the fuel tank from being discharged to the canister while the pressure in the fuel tank is lower than a third predetermined pressure in the engine running state;

20. The pressure control method according to claim 19, wherein:

the step (b) continues to allow evaporated fuel in the fuel tank to be discharged to the canister after the engine stops until either the time when the predetermined period elapses or the time when the pressure in the fuel tank reaches a second predetermined pressure as a result of lowering of the pressure, whichever time is earlier, the second predetermined pressure being lower than the third predetermined pressure;

the step (c-1) allows evaporated fuel in the fuel tank to be discharged to the canister while a pressure in the fuel tank is higher than the first predetermined pressure after the above mentioned earlier time in the engine stopped state;

the step (c-2) prevents evaporated fuel in the fuel tank from being discharged to the canister while a pressure in the fuel tank is lower than the first predetermined pressure after the above mentioned earlier time in the engine stopped state.

* * * * *

UNITED STATES PATENT AND TRADEMARK OFFICE

CERTIFICATE OF CORRECTION

PATENT NO. : 5,220,898

DATED : June 22, 1993

INVENTOR(S) : Toru KIDOKORO, et al.

It is certified that error appears in the above-identified patent and that said Letters Patent is hereby corrected as shown below:

Column 2, line 7, change "therefor." to --therefore."

Column 2, line 8, change "fllow" to --allow--.

Column 4, line 62, change "hereinafter. on" to --hereinafter. On--.

Column 6, line 26, change "pressure on" to --pressure. On--

Column 8, line 60, change "34. on" to --34. On-- and change "hank The" to --hand, the--.

Column 12, line 5, change "vave" to --valve--.

Column 13, line 18, change "controled" to --controlled--.

Column 13, line 41, delete "a".

Column 13, line 48, change "in kept" to --is kept--.

Column 14, line 24, delete "in" before "S201".

UNITED STATES PATENT AND TRADEMARK OFFICE
CERTIFICATE OF CORRECTION

PATENT NO. : 5,220,898

DATED : June 22, 1993

INVENTOR(S) : Toru KIDOKORO, et al.

It is certified that error appears in the above-identified patent and that said Letters Patent is hereby corrected as shown below:

Column 15, line 52, change "T22. on" to --T22. On--.

Column 16, line 61, change "whie" to --while--.

Column 18, line 55, change "ealier;" to --earlier;--.

Column 18, line 65, change "contro" to --control--.

Column 22, line 25, change "ealier;" to --earlier;--.

Column 22, line 35, change "oontrol" to --control-- and "aooording" to --according--.

Signed and Sealed this

Twelfth Day of April, 1994

Bruce Lehman

*Attest:*

BRUCE LEHMAN

*Commissioner of Patents and Trademarks*

*Attesting Officer*